US011851935B1

(12) United States Patent
Tien

(10) Patent No.: US 11,851,935 B1
(45) Date of Patent: Dec. 26, 2023

(54) DOOR OPENER CAPABLE OF CONTROLLING DOOR CLOSING SPEED

(71) Applicant: I-TEK METAL MFG. CO., LTD, Tainan (TW)

(72) Inventor: Hung-Jen Tien, Tainan (TW)

(73) Assignee: I-TEK METAL MFG. CO., LTD, Tainan (TW)

( * ) Notice: Subject to any disclaimer, the term of this patent is extended or adjusted under 35 U.S.C. 154(b) by 0 days.

(21) Appl. No.: 17/953,773

(22) Filed: Sep. 27, 2022

(30) Foreign Application Priority Data

Aug. 31, 2022 (TW) ..... 111132934

(51) Int. Cl.
*E05F 15/00* (2015.01)
*E05F 15/63* (2015.01)
*E05F 1/10* (2006.01)

(52) U.S. Cl.
CPC ..... *E05F 15/63* (2015.01); *E05F 1/105* (2013.01); *E05Y 2201/434* (2013.01); *E05Y 2201/474* (2013.01); *E05Y 2201/624* (2013.01); *E05Y 2201/716* (2013.01); *E05Y 2201/722* (2013.01); *E05Y 2800/11* (2013.01); *E05Y 2900/132* (2013.01)

(58) Field of Classification Search
CPC .... E05F 15/63; E05F 1/105; E05Y 2201/434; E05Y 2201/474; E05Y 2201/624; E05Y 2201/716; E05Y 2201/722; E05Y 2800/11; E05Y 2900/132
USPC ..... 49/138, 339, 340, 341, 342, 344
See application file for complete search history.

(56) References Cited

U.S. PATENT DOCUMENTS

| | | | |
|---|---|---|---|
| 6,177,771 | B1 | 1/2001 | Kinzer et al. |
| 6,634,140 | B1 | 10/2003 | Sellman |
| 6,786,006 | B2 | 9/2004 | Kowalczyk et al. |
| 6,891,479 | B1 | 5/2005 | Eccleston |
| 7,051,403 | B2 | 5/2006 | Homberg |
| 7,061,197 | B1 | 6/2006 | Mullet et al. |
| 7,068,179 | B2 | 6/2006 | Snell et al. |
| 7,143,547 | B2 | 12/2006 | Liles, Jr. |
| 7,234,201 | B2 | 6/2007 | Brown et al. |
| 7,282,883 | B2 | 10/2007 | Mullet et al. |
| 7,296,380 | B2 | 11/2007 | Backman |

(Continued)

FOREIGN PATENT DOCUMENTS

| | | | |
|---|---|---|---|
| DE | 102016202225 A1 * | 8/2017 | ..... E05F 15/63 |
| DE | 102017209467 A1 * | 12/2018 | ..... E05F 15/63 |

(Continued)

*Primary Examiner* — Jerry E Redman

(57) ABSTRACT

A door opener capable of controlling the door closing speed includes a driving device and a generator mode operating module electrically connected to the driving device. The driving device includes a motor which can be supplied with power to pivot a door from an open position to a closed position. The driving device detects the position of the door by a switch. When pivotal movement of the door is achieved without supplying power to the door, the pivotal movement sets the generator mode operating module to a generator mode or a non-generator mode. In the generator mode, the motor is impeded by the electromagnetic resistance, such that the pivoting speed of the door is reduced. In the non-generator mode, the motor is not impeded by the electromagnetic resistance, such that the pivoting speed of the door is increased.

8 Claims, 16 Drawing Sheets

(56) References Cited

U.S. PATENT DOCUMENTS

| | | | | |
|---|---|---|---|---|
| 7,316,096 | B2 | 1/2008 | Houser et al. | |
| 7,418,800 | B1 | 9/2008 | Sellman | |
| 7,484,333 | B2 | 2/2009 | Houser et al. | |
| 7,555,867 | B2 | 7/2009 | Liles, Jr. | |
| 7,717,155 | B2 | 5/2010 | Mullet | |
| 7,774,984 | B2 | 8/2010 | Hsu | |
| 7,966,771 | B2 | 6/2011 | Bienek | |
| 8,109,038 | B2 | 2/2012 | Houser et al. | |
| 8,169,169 | B2 | 5/2012 | Hass et al. | |
| 8,225,458 | B1 * | 7/2012 | Hoffberg | E05F 15/73 16/84 |
| 8,248,005 | B2 | 8/2012 | Romer | |
| 8,390,219 | B2 | 3/2013 | Houser | |
| 8,393,054 | B2 | 3/2013 | Bienek | |
| 8,407,937 | B2 | 4/2013 | Houser | |
| 8,415,902 | B2 | 4/2013 | Burris et al. | |
| 8,434,268 | B2 | 5/2013 | Nixon | |
| 8,499,495 | B2 | 8/2013 | Houser et al. | |
| 8,547,046 | B2 | 10/2013 | Burris et al. | |
| 8,601,744 | B2 | 12/2013 | Wildforster et al. | |
| 8,695,277 | B2 | 4/2014 | Romer et al. | |
| 8,773,237 | B2 * | 7/2014 | Burris | E05F 3/227 324/130 |
| 8,826,598 | B2 | 9/2014 | Ranaudo et al. | |
| 8,875,344 | B2 | 11/2014 | Salutzki et al. | |
| 8,904,710 | B2 | 12/2014 | Romer et al. | |
| 8,963,683 | B2 | 2/2015 | Romer | |
| 9,003,630 | B2 | 4/2015 | Hufen | |
| 9,045,927 | B1 | 6/2015 | Hoffberg | |
| 9,097,051 | B2 | 8/2015 | Hellwig | |
| 9,115,526 | B2 | 8/2015 | Houser et al. | |
| 9,121,217 | B1 | 9/2015 | Hoffberg | |
| 9,163,446 | B2 | 10/2015 | Houser et al. | |
| 9,181,744 | B2 | 11/2015 | Salutzki et al. | |
| 9,187,942 | B2 | 11/2015 | Wildforster | |
| 9,297,194 | B2 | 3/2016 | Bienek et al. | |
| 9,506,284 | B2 | 11/2016 | Braverman et al. | |
| 9,514,583 | B2 | 12/2016 | Zasowski et al. | |
| 9,631,412 | B2 | 4/2017 | Hellwig et al. | |
| 9,683,378 | B2 | 6/2017 | Houser et al. | |
| 9,695,620 | B2 | 7/2017 | Zasowski et al. | |
| 9,869,117 | B2 | 1/2018 | Houser et al. | |
| 9,995,076 | B1 | 6/2018 | Hoffberg | |
| 10,006,236 | B2 | 6/2018 | Hellwig et al. | |
| 10,024,094 | B2 | 7/2018 | Bell et al. | |
| 10,030,425 | B2 | 7/2018 | Zasowski et al. | |
| 10,030,426 | B2 | 7/2018 | Langenberg | |
| 10,077,591 | B2 | 9/2018 | Hass | |
| 10,180,023 | B2 | 1/2019 | Zasowski et al. | |
| 10,208,520 | B2 | 2/2019 | Long et al. | |
| 10,236,801 | B2 | 3/2019 | Dye et al. | |
| 10,253,540 | B2 | 4/2019 | Bell et al. | |
| 10,280,670 | B2 | 5/2019 | Roberts | |
| 10,280,678 | B1 | 5/2019 | Rendon, Jr. et al. | |
| 10,304,272 | B2 | 5/2019 | Kvinge et al. | |
| 10,344,502 | B2 | 7/2019 | McKibben et al. | |
| 10,415,301 | B2 | 9/2019 | Kuan | |
| 10,458,151 | B1 | 10/2019 | Shen | |
| 10,472,873 | B2 | 11/2019 | Ladha et al. | |
| 10,559,151 | B2 | 2/2020 | Kvinge et al. | |
| 10,704,310 | B1 | 7/2020 | Barbon et al. | |
| 10,704,313 | B2 | 7/2020 | Houser et al. | |
| 10,724,288 | B2 | 7/2020 | Baumgarte | |
| 11,187,022 | B1 * | 11/2021 | Hoffberg | E05F 3/222 |
| 2005/0154612 | A1 | 7/2005 | Smith et al. | |
| 2007/0256362 | A1 | 11/2007 | Hansen | |
| 2007/0268132 | A1 * | 11/2007 | Milo | E05B 47/02 340/545.1 |
| 2011/0252597 | A1 * | 10/2011 | Burris | F03G 7/08 290/1 R |
| 2013/0009785 | A1 | 1/2013 | Finn et al. | |
| 2014/0255252 | A1 | 9/2014 | Stratman et al. | |
| 2014/0282934 | A1 | 9/2014 | Miasnik et al. | |
| 2016/0348415 | A1 | 12/2016 | Baumgarte | |
| 2018/0223577 | A1 * | 8/2018 | Hucker | E05F 15/73 |
| 2018/0334841 | A1 | 11/2018 | Langenberg et al. | |
| 2018/0334845 | A1 * | 11/2018 | Hass | E05F 15/611 |
| 2019/0043296 | A1 | 2/2019 | Baumgarte et al. | |
| 2019/0145138 | A1 | 5/2019 | Eickhoff | |
| 2019/0153764 | A1 | 5/2019 | Baumgarte | |
| 2019/0264486 | A1 | 8/2019 | Toloday et al. | |
| 2019/0319557 | A1 | 10/2019 | Dye et al. | |
| 2019/0338576 | A1 | 11/2019 | Wang | |
| 2019/0345738 | A1 | 11/2019 | McKibben et al. | |
| 2019/0383080 | A1 | 12/2019 | Barbon et al. | |
| 2020/0037142 | A1 | 1/2020 | Lofton | |
| 2020/0190885 | A1 | 6/2020 | Coleman | |
| 2020/0256108 | A1 | 8/2020 | Shetty et al. | |
| 2021/0012598 | A1 | 1/2021 | Giebat et al. | |
| 2021/0023248 | A1 | 1/2021 | Townsend et al. | |
| 2021/0056791 | A1 | 2/2021 | Shen | |

FOREIGN PATENT DOCUMENTS

| | | | | |
|---|---|---|---|---|
| EP | 2933415 | A1 * | 10/2015 | E05F 15/63 |
| EP | 3550528 | A1 | 10/2019 | |
| KR | 20210019168 | A | 2/2021 | |
| KR | 20210033154 | A | 3/2021 | |
| WO | 2021007588 | A1 | 1/2021 | |
| WO | 2021050616 | A1 | 3/2021 | |
| WO | WO-2022063950 | A1 * | 3/2022 | |
| WO | WO-2022063952 | A1 * | 3/2022 | |
| WO | WO-2023036744 | A1 * | 3/2023 | |

* cited by examiner

DOOR OPENER CAPABLE OF CONTROLLING DOOR CLOSING SPEED

BACKGROUND OF THE INVENTION

The present invention relates to a door opener and, more particularly, to a door opener capable of controlling the door closing speed.

An electric door opener available on the market generally includes a driving device having a motor. The driving device actuates a connecting rod to pivot a door for opening or closing purposes. A manual return module is disposed on the driving device to assure that the door can still be manually opened when the electric door opener is out of electricity while providing an automatic door closing function. A spring is compressed when the door is opened. When the door is released, the spring pushes the door for automatically closing the door.

When the above door opener is without the operating power, the door moves from the open position to the closed position under the action of the spring. When the door is closed too fast without proper control, the door will strongly impact the frame under the large door closing force, accelerating damage to the door and the door opener.

BRIEF SUMMARY OF THE INVENTION

In view of the above drawbacks, the present invention provides a door opener comprising:

a casing;

a motor coupled to the casing and including a rotor;

a generator mode operating module electrically connected to the motor, wherein the generator mode operating module is configured to set the motor to a generator mode, wherein when the generator mode operating module sets the motor to the generator mode, rotation of the rotor outputs electric current and is impeded by an electromagnetic resistance;

a first transmission member pivotably mounted to the casing, wherein the motor is configured to drive the first transmission member to pivot, wherein the first transmission member includes a first detecting portion and is configured to operatively connect with a door to thereby operatively connect the door with the rotor, wherein when the motor is supplied with power to operate, the first transmission member is driven to pivot, thereby pivoting the door to an open position or a closed position, and wherein when the rotation of the rotor is impeded by the electromagnetic resistance, a pivoting speed of the door is reduced; and a switching module in electrical connection with the generator mode operating module, wherein when the first detecting portion is in one of a first status activating the switching module and a second status not activating the switching module, the generator mode operating module sets the motor to the generator mode, wherein when the first detecting portion is in another of the first status activating the switching module and the second status not activating the switching module, the generator mode operating module does not set the motor to the generator mode, wherein when the motor is set to the generator mode and the pivotal movement of the door is not caused by operation of the motor supplied with power, rotation of the rotor is impeded by the electromagnetic resistance to reduce the pivoting speed of the door, wherein when the motor is not set to the generator mode and the pivotal movement of the door is not caused by operation of the motor supplied with power, rotation of the rotor is not impeded by the electromagnetic resistance, and the pivoting speed of the door is increased.

By the provision of the generator mode operating module according to the present invention, when the door opener is in a state of interruption of power supply state or loses the power for operation, the door can be manually pivoted to set the motor to the generator mode, such that the rotor must overcome the electromagnetic resistance, which further effectively controls the pivoting speed of the door towards the closed position under the action of the return spring. Therefore, the door-closing speed will not be too fast, and the door-closing force will not be too large.

In an example, the door opener further comprises a manual return module operatively connected to the first transmission member. The manual return module includes a return spring. The return spring is configured to pivot the door from the open position to the closed position when the door opener loses power and the door is in the open position, causing the first transmission member to actuate the rotor to rotate.

In an example, the switching module further includes:

an installation seat fixed to the casing, wherein the installation seat includes an installation groove and a movement hole intercommunicating with the installation groove;

a switch mounted in the installation groove; and a push rod movably received in the movement hole, wherein the push rod is located between the switch and the first transmission member, wherein pivotal movement of the first transmission member causes the first detecting portion to move to a position aligned with the push rod or another position not aligned with the push rod, wherein when the first detecting portion is aligned with the push rod, the switch is not activated, and wherein when the first detecting portion is not aligned with the push rod, the switch is activated.

In an example, the first transmission member further includes a second detecting portion spaced from the first detecting portion in a circumferential direction about a rotating axis of the first transmission member. When the second detecting portion is aligned with the push rod, the switch is not activated. When the second detecting portion is not aligned with the push rod, the switch is activated. The first detecting portion is configured to reduce an initial speed of the door starting to pivot from the open position to the closed position. The second detecting portion is configured to reduce the pivoting speed of the door approaching the closed position.

In an example, each of the first and second detecting portions is in the form of a groove. The first and second detecting portions are spaced from each other by 90°-120° in the circumferential direction about the rotating axis of the first transmission member. An extent of the first detecting portion in the circumferential direction about the rotating axis of the first transmission member is greater than an extent of the first detecting portion in the circumferential direction about the rotating axis of the first transmission member.

In an example, the door opener further comprises a second transmission member coupled with the motor. The first transmission member includes a first gear and a second gear rotating jointly with the first gear. The second transmission member includes a third gear meshed with the second gear. The first detecting portion is mounted on a face of the second gear. The manual return module includes a sliding member operatively coupled with the return spring. The sliding member meshes with the first gear. When the motor operates, the sliding member moves in a lateral direction, and the return spring is compressed or elongated. The sliding member is configured to actuate the first transmission member, the second transmission member, and the motor to rotate when the door pivots.

In an example, the manual return module further includes:

a connecting rod coupled to the sliding member to move jointly, wherein the connecting rod includes a threaded portion; and an adjusting ring in threading connection with the threaded section of the connecting rod and located outside of the casing, wherein when the first transmission member does not pivot, rotation of the adjusting ring causes displacement of the adjusting ring in the lateral direction to change an extent of pre-compression of the return spring, wherein when the first transmission member pivots in a first direction, the connecting rod and the adjusting ring together move in the lateral direction towards the first transmission member, and the return spring is compressed, and wherein the first transmission member pivots in a second direction reverse to the first direction, the connecting rod and the adjusting ring together move in the lateral direction away from the first transmission member, and the return spring restores its length.

In an example, the manual return module further includes:

a fixing sleeve mounted around the return spring and not movable in the lateral direction, wherein an end of the return spring abuts against the fixing sleeve; and a movable sleeve mounted around the return spring and movably mounted to the fixing sleeve in the lateral direction, wherein another end of the return spring abuts against the movable sleeve, wherein the adjusting ring abuts an outer side of the movable sleeve, wherein when the first transmission sleeve does not pivot and the adjusting ring rotates and displaces in the lateral direction, the movable sleeve and the adjusting ring displace together in the lateral direction, wherein the extent of pre-compression of the return spring increases when a length of a portion of the connecting rod outside of the movable sleeve increases, and wherein the connecting rod, the adjusting ring, and the fixing sleeve are jointly movable in the lateral direction when the first transmission member pivots.

The present invention will become clearer in light of the following detailed description of illustrative embodiments of this invention described in connection with the drawings.

Figure 1:
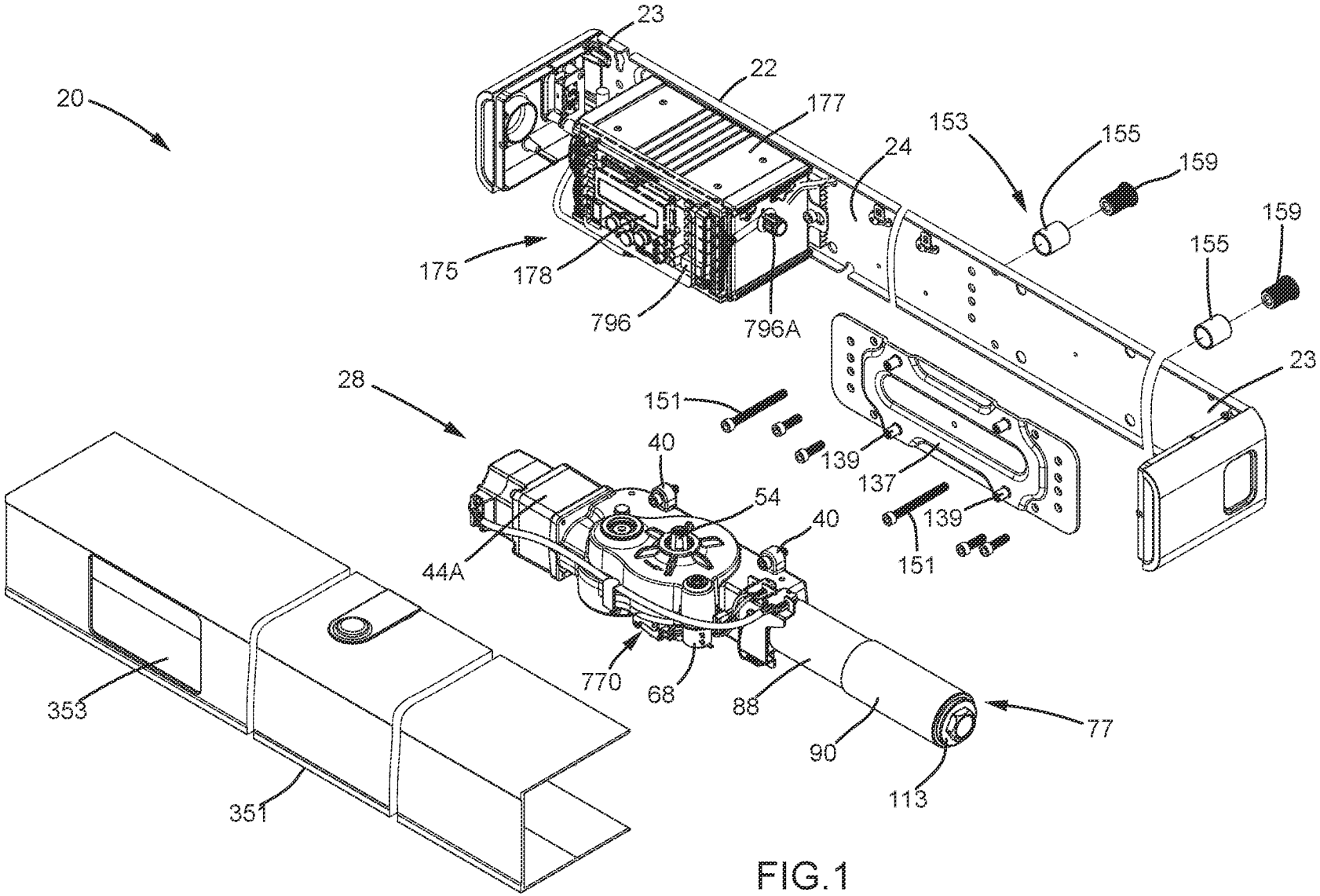
FIG. 1 is an exploded, perspective view of a door opener of an embodiment according to the present invention.
Figure 2:
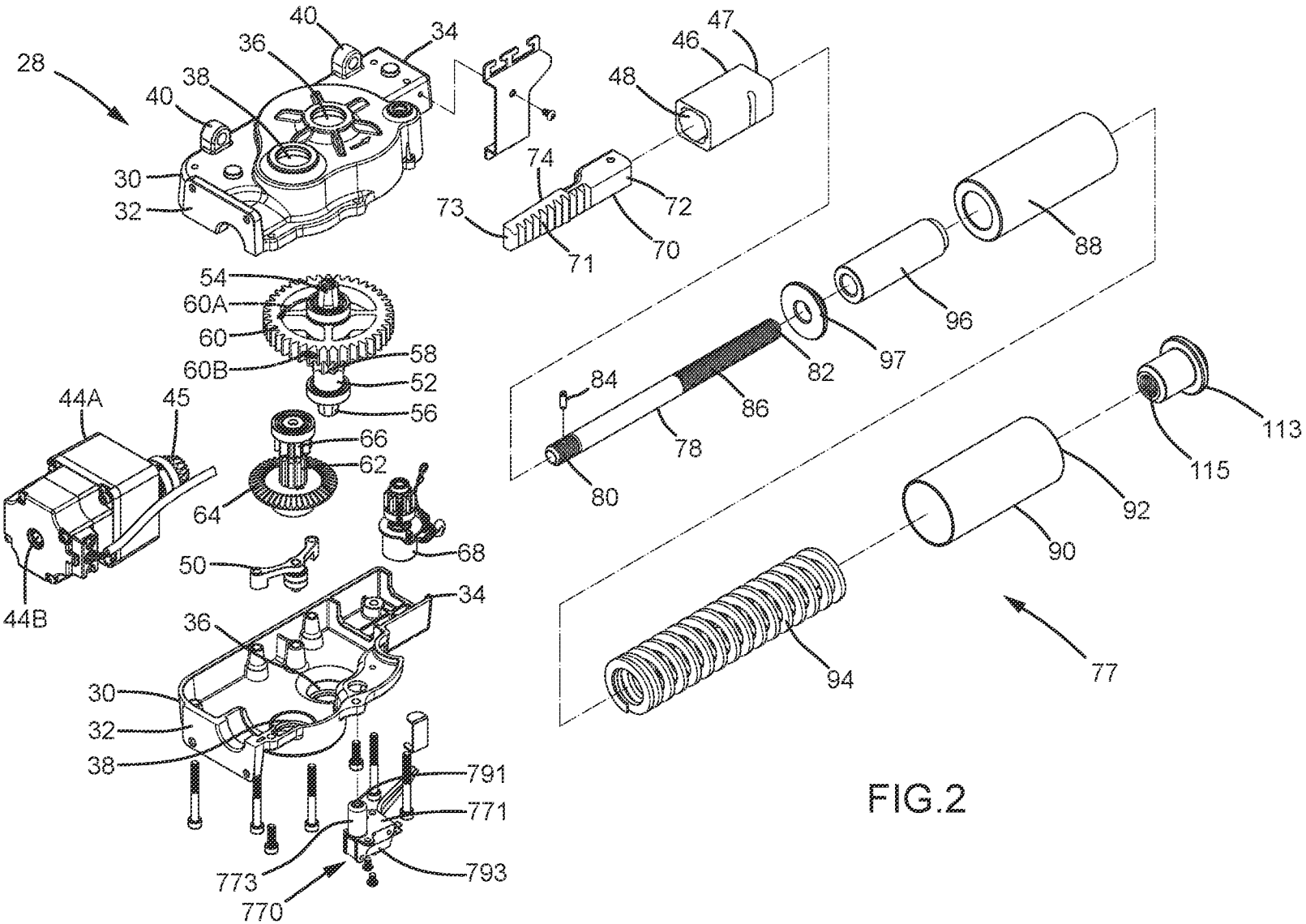
FIG. 2 is an exploded, perspective view of a driving device of the door opener of FIG. 1.
Figure 3:
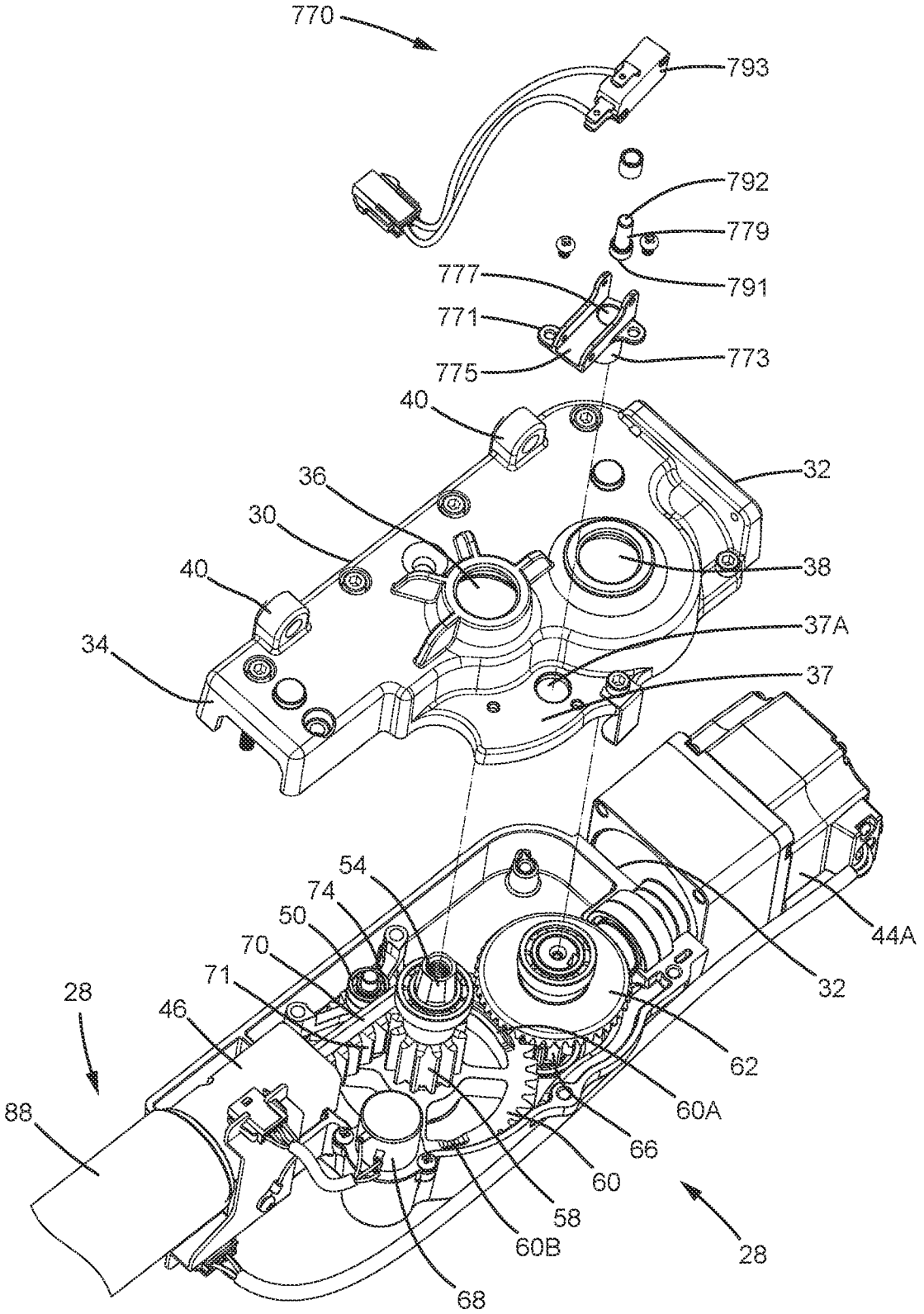
FIG. 3 is another exploded, perspective view of the driving device of the door opener of FIG. 1.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "inner", "outer", "side", "end", "portion", "section", "axial", "lateral", "vertical", "circumferential", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 4:
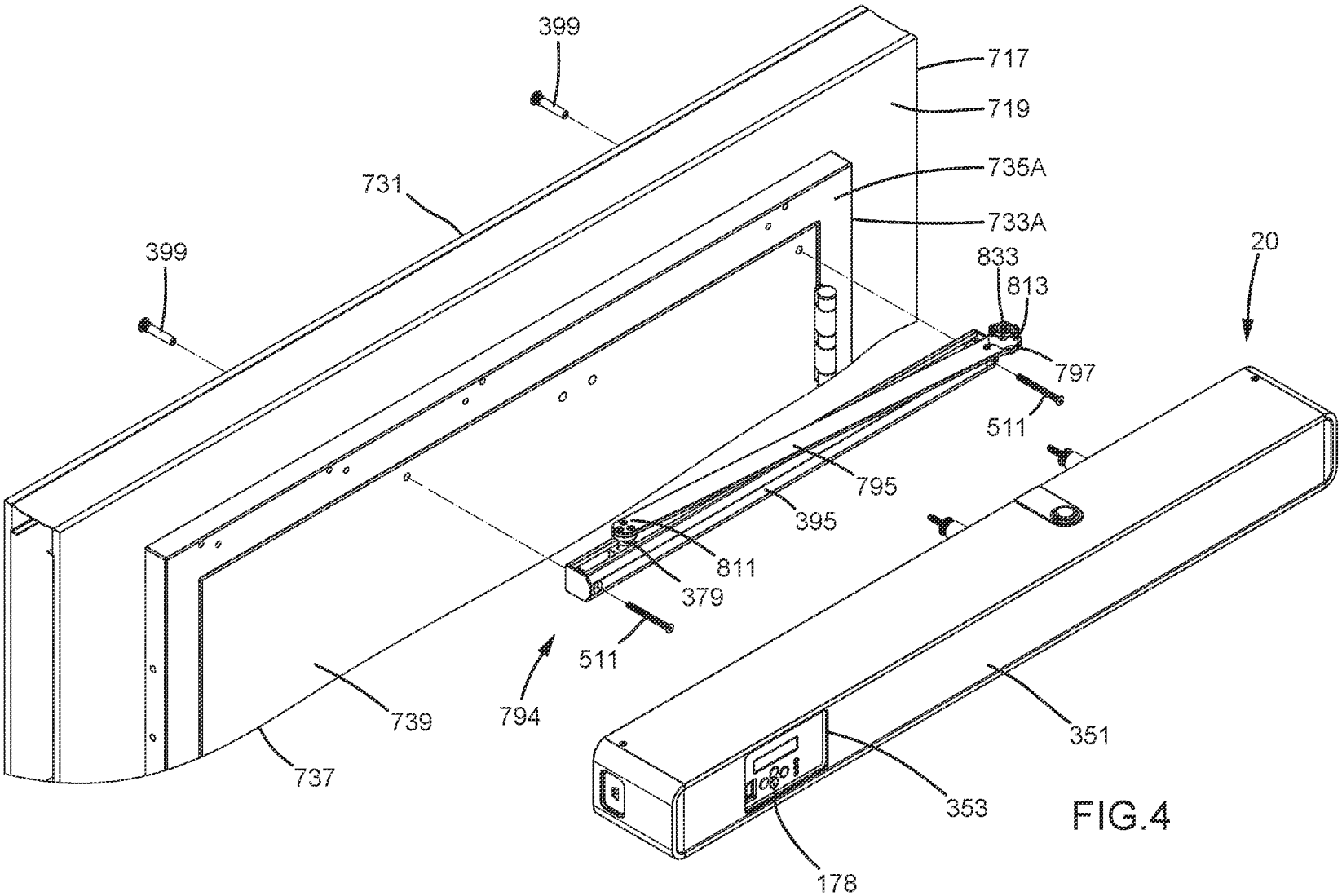
FIG. 4 is a diagrammatic exploded, perspective view illustrating mounting of the door opener of FIG. 1 to a frame.
Figure 8:
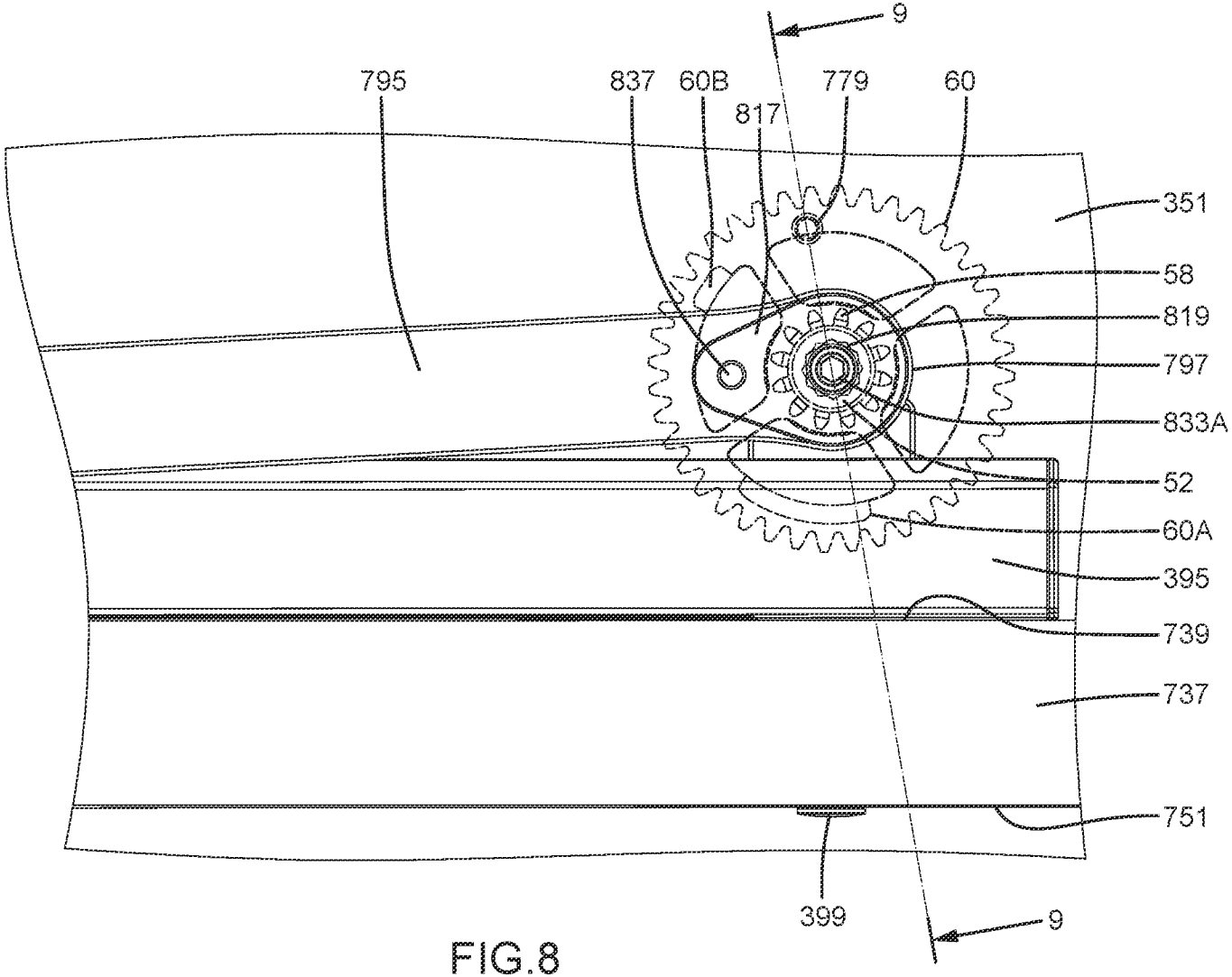
FIG. 8 is a bottom view of FIG. 7.

The present invention relates to a door opener capable of controlling the door closing speed. The door opener is mounted to an outer side of a door frame for opening and closing a door. The door opener includes a driving device configured to provide the power for the door opener to push the door. With reference to FIGS. 4 and 8, the door opener 20 is mounted to a frame 717 including a first side 719 and a second side 731 parallel to and spaced from the first side 719. The frame 717 further includes a first protrusive portion 733A on the first side 719. The first protrusive portion 733A includes a first protrusive wall 735A on an outer side of the first side 719. The first protrusive portion 733A is pivotably connected to a door 737. The door 737 includes a first surface 739 and a second surface 751 parallel to and spaced from the first surface 739. The first surface 739 and the first side 719 are on the same side. The second surface 751 and the second surface 731 are on the same side. The first surface 739 is substantially aligned with the first protrusive wall 735A. The second surface 751 is located between the second side 731 and the first surface 739.

Figure 6:
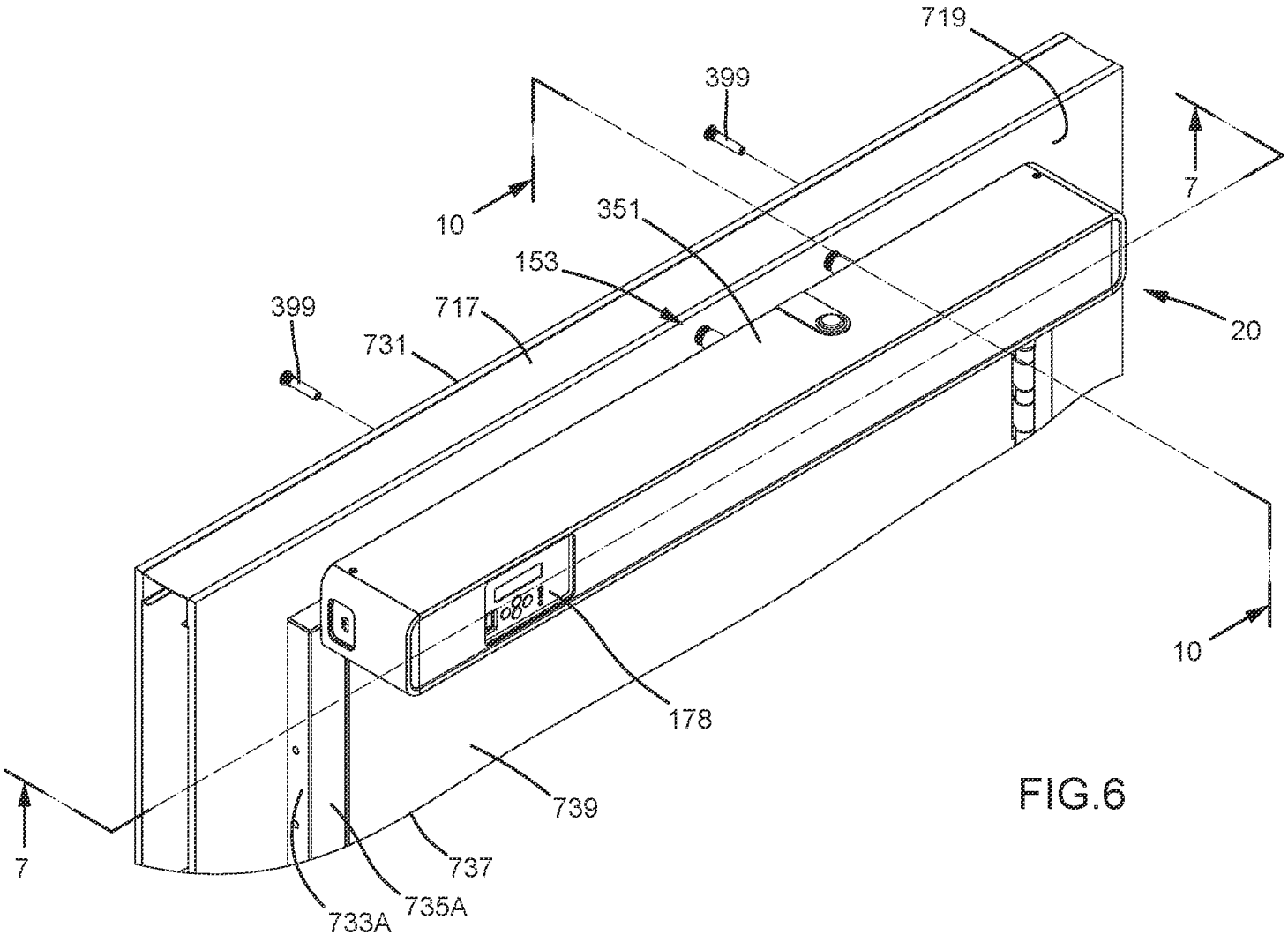
FIG. 6 is diagrammatic perspective view of the frame and the door opener of FIG. 4 after assembly.

With reference to FIGS. 1 and 6, the door opener 20 includes a mounting seat 22 extending in a lateral direction. The mounting seat 22 has two ends 23 spaced from each other in the lateral direction and a bottom wall 24 extending between the two ends 23. The mounting seat 22 can be secured to the frame 717 by screws and can be mounted on the first protrusive portion 733A.

The control device 175 includes a protective housing 177 and a control panel 178 coupled to an end of the protective housing 177. An electronic module required for operation of the door opener 20 is disposed in the protective housing 177. An independent generator mode operating module 796 is also mounted in the protective housing 177 and includes an adjusting knob 796A on an outer side of the protective housing 177. The door opener 20 can be operated or set through use of the control panel 178. The control device 175 is mounted on the bottom wall 24 of the mounting seat 22.

The door opener 20 further includes a reinforcing seat 137 coupled to the mounting seat 22. The reinforcing seat 137 can be made of a metal sheet. The reinforcing seat 137 includes four coupling pegs 139 protruding from an outer face thereof. The four coupling pegs 139 are arranged to be symmetric in the vertical direction and left/right direction.

The reinforcing seat 137 abuts against an inner face of the bottom wall 24 of the mounting seat 22. The reinforcing seat 137 is fixed by a plurality of screws extending through the reinforcing seat 137 and the bottom wall 24 and in threading connection with the first protrusive portion 733A of the frame 717, such that the mounting seat 22 is fixed to the frame 717 and that the reinforcing seat 137 tightly abuts against the inner face of the bottom wall 24. Furthermore, the plurality of coupling pegs 139 of the reinforcing seat 137 protrudes away from the bottom wall 24.

With reference to FIGS. 1-3, 7, and 9, the door opener 20 further includes a driving device 28 coupled with the reinforcing seat 137. The driving device 28 includes a casing 30 having four lugs 40 on an outer side thereof for respectively coupling with the four coupling pegs 139 of the reinforcing seat 137. The four lugs 40 are also arranged to be symmetric in the vertical direction and left/right direction. The casing 30 further includes a first mounting side 32 and the second mounting side 34 spaced from the first mounting side 32. The casing 30 further includes two first pivotal portions 36 and the two second pivotal portions 38. Each of the two first pivotal portions 36 is located between an associated one of the two second pivotal portions 38 and the second mounting side 34 in the lateral direction. Each of the second pivotal portions 38 is located between an associated one of the first pivotal portions 36 and the first mounting side 34 in the lateral direction. The casing 30 further includes a third mounting side 37 between the first and second mounting sides 32 and 34. The third mounting side 37 has a through-hole 37A.

The four lugs 40 of the casing 30 are coupled with the four coupling pegs 139, and four screws are used to threadedly coupled with the four coupling pegs 139. The casing 30 is, thus, fixed to the reinforcing seat 137.

The two first pivotal portions 36 of the casing 30 rotatably receives a first transmission member 52. The first transmission member 52 includes a first gear 58 and a second gear 60 larger than the first gear 58. The first and second gears 58 and 60 are coaxial and rotate synchronously. The second gear 60 includes first and second detecting portions 60A and 60B on a side thereof. The first and second detecting portions 60A and 60B are spaced from each other by 90°-120° in a circumferential direction about a rotating axis of the first transmission member 52. An extent of the first detecting portion 60A in the circumferential direction about the rotating axis of the first transmission member 52 is greater than an extent of the first detecting portion 60A in the circumferential direction about the rotating axis of the first transmission member 52. The first and second detecting portions 60A and 60B can be, but not limited to, in the form of grooves. The first transmission member 52 further includes first and second mounting ends 54 and 56 which extend beyond the two first pivotal portions 36 and which have non-circular cross sections. Each of the first and second mounting ends 54 and 56 includes a screw hole and is substantially conic. The first and second detecting portions 60A and 60B face the second mounting end 56.

The two second pivotal portions 38 of the casing 30 rotatably receive a second transmission member 62. The second transmission member 62 includes a third gear 66 meshed with the second gear 60 and a follower gear 64 larger than the third gear 66. The follower gear 64 and the third gear 66 are coaxial and rotate synchronously. The follower gear 64 can be a bevel gear.

A motor 44A is mounted to the first mounting side 32 of the casing 30. A shaft of the motor 44A extends into the casing 30 and is jointly rotatable with a driving gear 45. The driving gear 45 can be a bevel gar and meshes with the follower gear 64. When the motor 44A operates, the driving gear 45 drives the second transmission member 62 to rotate, and the second transmission member 62 drives the first transmission member 52 to pivot.

A detection unit 68 is mounted to the casing 30 and includes a pinion meshed with the second gear 60. When the second gear 60 rotates, the detection unit 68 detects operation of the motor 44A as well as the operating time of the motor 44A.

The door opener 20 further includes a switching module 770 mounted on an outer side of the casing 30. The switching module 770 includes an installation seat 771 having an installation groove 775 and a sleeve portion 773 spaced from the installation groove 775. The sleeve portion 773 includes a movement hole 777 intercommunicating with the installation groove 775. The installation seat 771 is fixed to the third mounting side 37. The sleeve portion 773 extends through the through-hole 37A into the casing 30.

Figure 9:
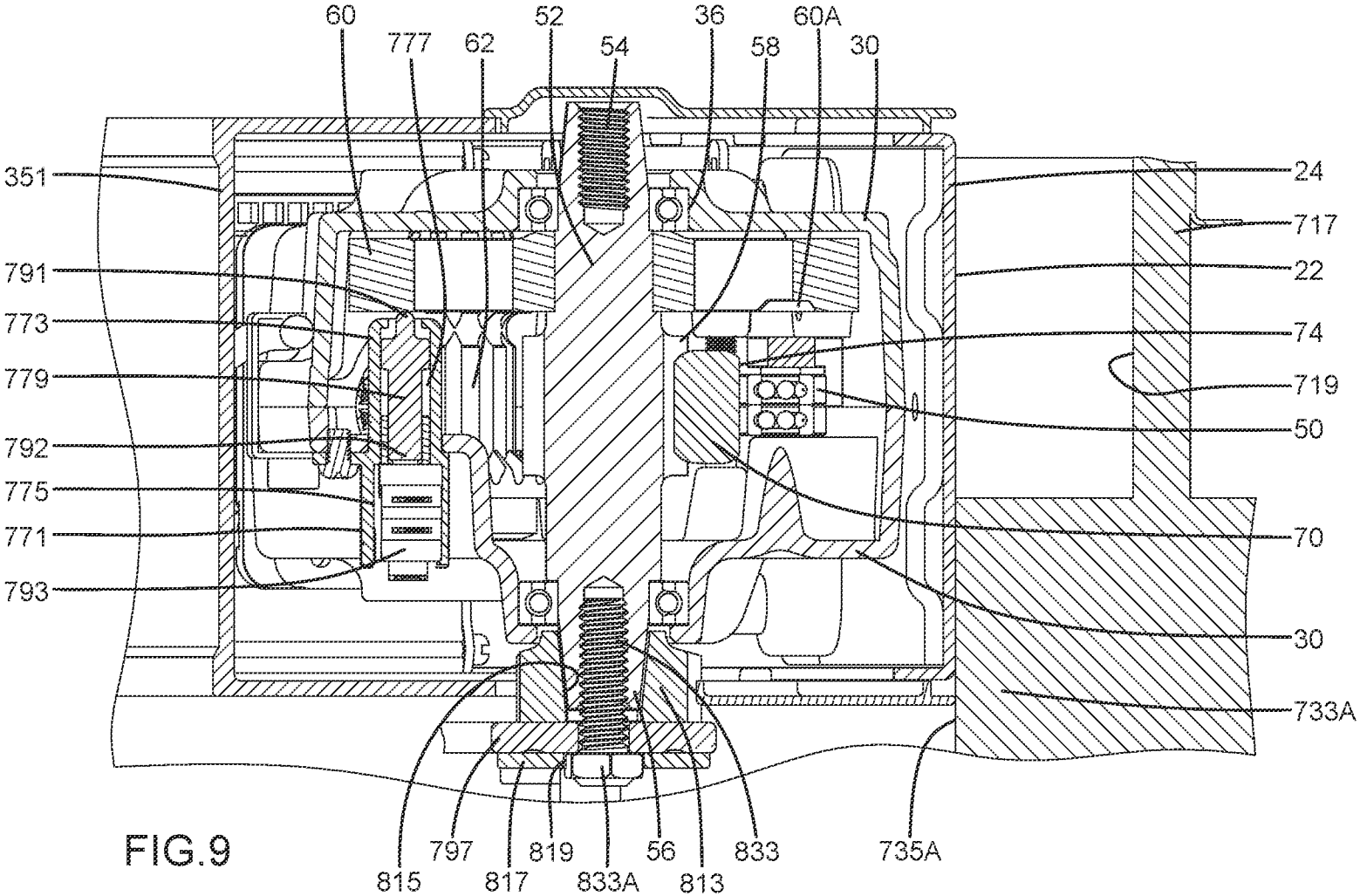
FIG. 9 is a cross sectional view taken along section line 9-9 of FIG. 8.
Figure 14:
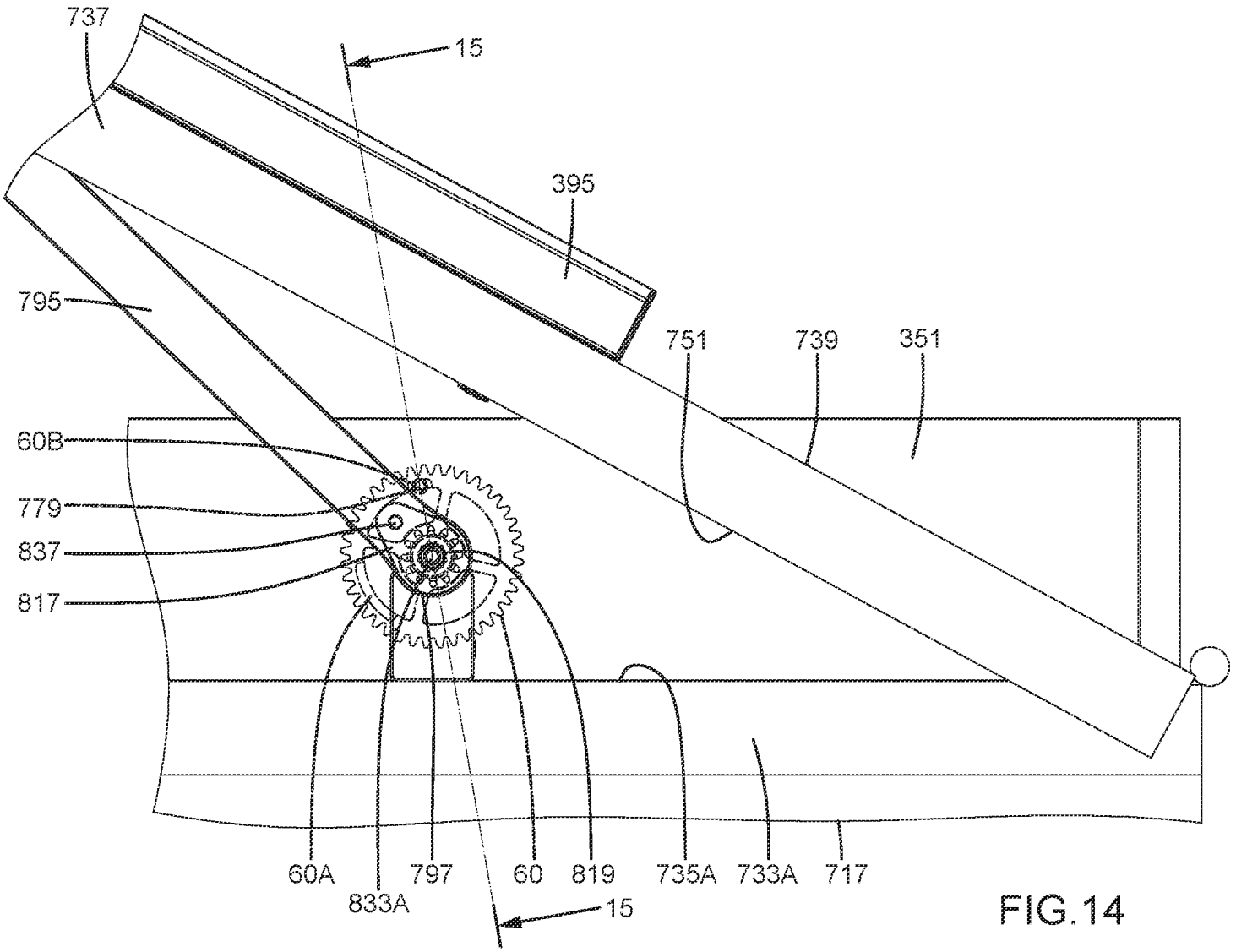
FIG. 14 is a view similar to FIG. 13 with the door pivoted to a position near the closed position.

The switching module 770 includes a push rod 779 and a switch 793. The switch 793 is received in the installation groove 775 of the installation seat 771. The push rod 779 includes an inner end 791 and an outer end 792. The push rod 779 is slidably received in the movement hole 777 and is located between the switch 793 and the second gear 60, as shown in FIGS. 9 and 14. The outer end 792 of the push rod 779 is adjacent to the switch 793. The inner end 791 of the push rod 779 is located in the casing 30. The push rod 779 is movable in an axial direction of the movement hole 777 to activate or not activate the switch 793.

According to the form shown, the switch 793 can be, but not limited to, a micro switch. When the push rod 779 moves towards or away from the micro switch, the micro switch can be activated or not activated. The switch 793 is in electrical connection with the generator mode operating module 796 to form a circuit. Thus, when the switch 793 is activated, the circuit of the generator mode operating module 796 can become an open circuit or a closed circuit. In a case that the switch 793 is in a normally closed mode, the circuit of the generator mode operating module 796 is a closed circuit when the switch 793 is not activated, and the circuit of the generator mode operating module 796 is an open circuit when the switch 793 is activated. In another case that the switch 793 is in a normally open mode, the circuit of the generator mode operating module 796 is an open circuit when the switch 793 is not activated, and the circuit of the generator mode operating mode 796 is a closed circuit when the switch 793 is activated.

A supporting sleeve 46 is disposed on the second mounting seat 34 of the casing 30. The supporting sleeve 46 includes a sliding groove 48 extending in the lateral direction to an outer end face 47 of the supporting sleeve 46. A roller 50 is disposed in the casing 30 and is located between the first and second mounting sides 32 and 34. The outer end face 47 of the supporting sleeve 46 is flush with an outer side of the casing 30.

The driving device 28 further includes a sliding member 70 slidably coupled to the supporting sleeve 46. The sliding member 70 includes a coupling portion 72 and a tail 73. The sliding member 70 further includes an abutting face 74 extending from the tail 73 to the coupling portion 72 and a rack 71 extending between the coupling portion 72 and the tail 73. The coupling portion 72 can be in the form of a hole. The sliding member 70 is slidably coupled with the sliding groove 48 of the supporting sleeve 46. The abutting face 74 abuts the roller 50. The rack 71 of the sliding member 70 meshes with the first gear 58 of the first transmission member 52, and the coupling portion 72 faces the outer end face 47. When the motor 44 operates, the sliding member 70 displaces in the lateral direction. Furthermore, since the tail 73 is free of rack, after the rack 71 of the sliding member 70 meshes with the first gear 58, the sliding member 70 can only displace within the extent of the rack 71 in the lateral direction. Namely, when the sliding member 70 displaces in the lateral direction, the rack 71 cannot disengage from the first gear 58.

The driving device 28 further includes a manual return module 77 coupled to the sliding member 70. The manual return module 77 includes a connecting rod 78 having an inner end 80 and an outer end 82 spaced from the inner end 80. The connecting rod 78 further includes a threaded section 86 extending from the outer end 82 towards but spaced from the inner end 80. The inner end 80 of the connecting rod 78 is coupled with the coupling portion 72 of the sliding member 70 by a locking pin 84. Thus, the connecting rod 78 and the sliding member 70 displace synchronously in the lateral direction.

The manual return module 77 further includes a fixing sleeve 88, an inner end cap 97, a movable sleeve 90, and a return spring 94. The return spring 94 is mounted around the connecting rod 78. The fixing sleeve 88 is mounted around the return spring 94. The inner end cap 97 abuts against the outer end face 47 of the supporting sleeve 46 and the second mounting side 34 of the casing 30. An end of the fixing sleeve 88 abuts against the inner end cap 97. An end of the return spring 94 abuts against the fixing sleeve 88. Namely, the end of the fixing sleeve 88 is located between the inner cap end 97 and the end of the return spring 94.

The movable sleeve 90 is mounted around the return spring 94. An end of the movable sleeve 90 is movably coupled with an end of the fixing sleeve 88 remote from the inner end cap 97. Another end of the movable sleeve 90 is abutted by another end of the return spring 94. Since an outer diameter of the movable sleeve 90 is slightly greater than an inner diameter of the fixing sleeve 88, the movable sleeve 90 can displace in the lateral direction relative to the fixing sleeve 88. Furthermore, an inner diameter of the movable sleeve 90 is slightly larger than an outer diameter of the return spring 94, such that when the return spring 94 is compressed, the movable sleeve 90 avoids the return spring 94 from distorting.

The manual return module 77 further includes an inner tube 96 mounted between the connecting rod 78 and the return spring 94 and located adjacent to the inner end 80 of the connecting rod 78. An outer diameter of the inner tube 96 is slightly smaller than an inner diameter of the return spring 94. Thus, when the return spring 94 is compressed, the inner tube 96 cooperates with the movable sleeve 90 to assure that the return spring 94 will not distort.

The manual return module 77 includes an adjusting ring 113 having a screw hole 115. The adjusting ring 113 is in threading connection with the threaded section 86 of the connecting rod 78. The adjusting ring 113 is on the outer side of the movable sleeve 90. An end of the movable sleeve 90 abuts against the adjusting ring 113. When the adjusting ring 113 rotates, the adjusting ring 113 moves together with the movable sleeve 90 in the lateral direction to compress the return spring 90 or to permit extension of the return spring 90.

The door opener 20 further includes a linking unit 794 connected between the driving device 28 and the door 737. According to an example shown in FIGS. 4, 5, and 8, the linking unit 794 includes a first push rod 795 having a first end 797 and a second end 811. The first end 797 of the first push rod 795 has a through-hole 797 B and a plurality of installation holes 797A surrounding the through-hole 797B. The first end 797 further includes an eccentric locking hole 799 outside of the plurality of installation holes 797A. The second end 811 includes three through-holes arranged in a triangular pattern.

The linking unit 794 includes a first connecting member 813 having a connecting hole 815 with non-circular cross sections. The connecting hole 815 can be in the form of a conic hole cooperating with the first and second mounting ends 54 and 56. The first connecting member 813 is disposed on the first end 797 of the first push rod 795 by a plurality of fasteners 835 extending through the plurality of installation holes 797A of the first push rod 795 and is in threading connection with the first connecting member 813. Thus, the first connecting member 813 and the first push rod 795 can pivot jointly, and the connecting hole 815 of the first connecting member 813 is aligned with the through-hole 797B of the first push rod 795.

The first connecting member 813 can be pivotably coupled with the first mounting end 54 or the second mounting end 56 of the first transmission member 52 according to the direction or type of assembly. According to the form shown, the first connecting member 813 is coupled with the second mounting end 56. Since both the second mounting end 56 and the connecting hole 815 have a conicity, the second mounting end 56 and the connecting hole 815 can be self-centered during coupling to achieve simple coupling. A connecting screw 833 extends from the through-hole 797A of the first push rod 795 through the first connecting member 813 to threadedly engage with the second mounting end 56 of the first transmission member 52. After the connecting screw 833 is tightened, the second mounting end 56 and the connecting hole 815 can be tightly coupled due to the conicity thereof. The connecting screw 833 includes a head 833A having polygonal cross sections and abutting a surface of the first end 797 of the first push rod 795. Thus, the first transmission member 52, the first push rod 795, the first connecting member 813, and the connecting screw 833 can pivot jointly. Thus, the first transmission member 52 pushes the first push rod 795 to pivot when the motor 44A operates.

The linking unit 794 further includes an anti-loose member 817 coupled with the first push rod 795. The anti-loose member 817 includes a polygonal hole 819 and an eccentric hole 831 spaced from the polygonal hole 819.

Figure 5:
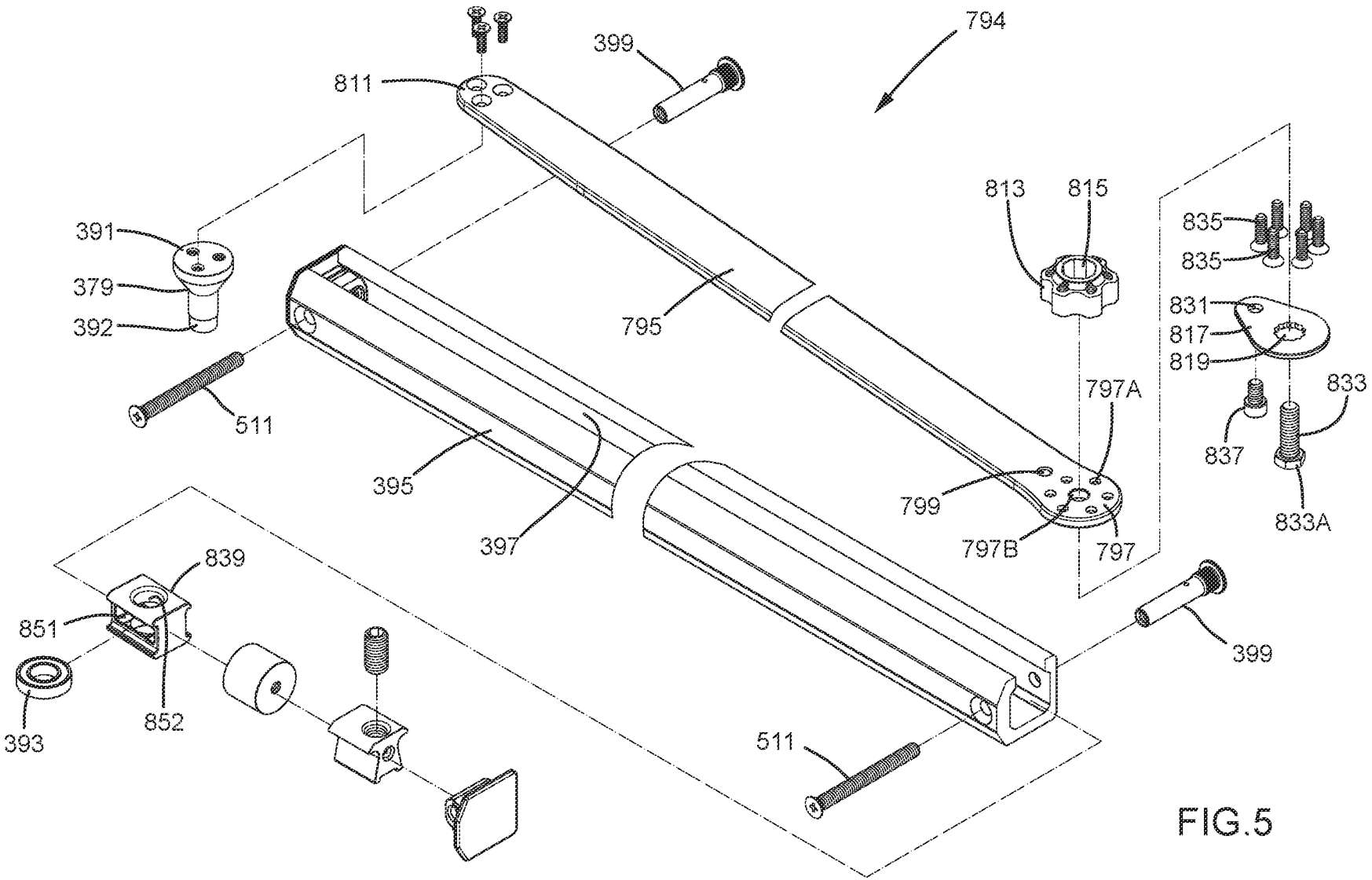
FIG. 5 is an exploded, perspective view of a linking unit of the door opener.

With reference to FIGS. 5, 8, and 9, the anti-loose member 817 abuts the first end 797 of the first push member 795. The head 833A of the connecting screw 833 is non-rotatably received in the polygonal hole 819 of the anti-loose member 817. The eccentric hole 813 of the anti-loose member 817 and the eccentric hole 799 of the first push rod 795 are aligned with each other and connected by an anti-loose screw 837 via threading connection. Thus, the anti-loose member 817 cannot rotate relative to the first push rod 795, such that the head 833A of the connecting screw 833 is coupled with the polygonal hole 819 of the anti-loose member 817. Thus, the connecting screw 833 jointly rotatable with the first transmission member 52 about the same rotating axis cannot rotate relative to the anti-loose member 817. Therefore, the connecting screw 833 will not disengage from the first transmission member 52 during pivotal movement of the first transmission member 52.

The linking unit 794 further includes a guiding wheel member 379 coupled to the second end 811. The guiding wheel member 379 includes an enlarged portion 391 and a narrower portion 392 which tapers away from the enlarged portion 391. The enlarged portion 391 of the guiding wheel member 379 is associated with the second end 811 of the first push rod 795. In this embodiment, three screws extend through the three through-holes of the second end 811 of the first push rod 795 to be in threading connection with screw holes in the enlarged portion 391. Thus, the guiding wheel member 379 is securely coupled with the first push rod 795.

Figure 10:
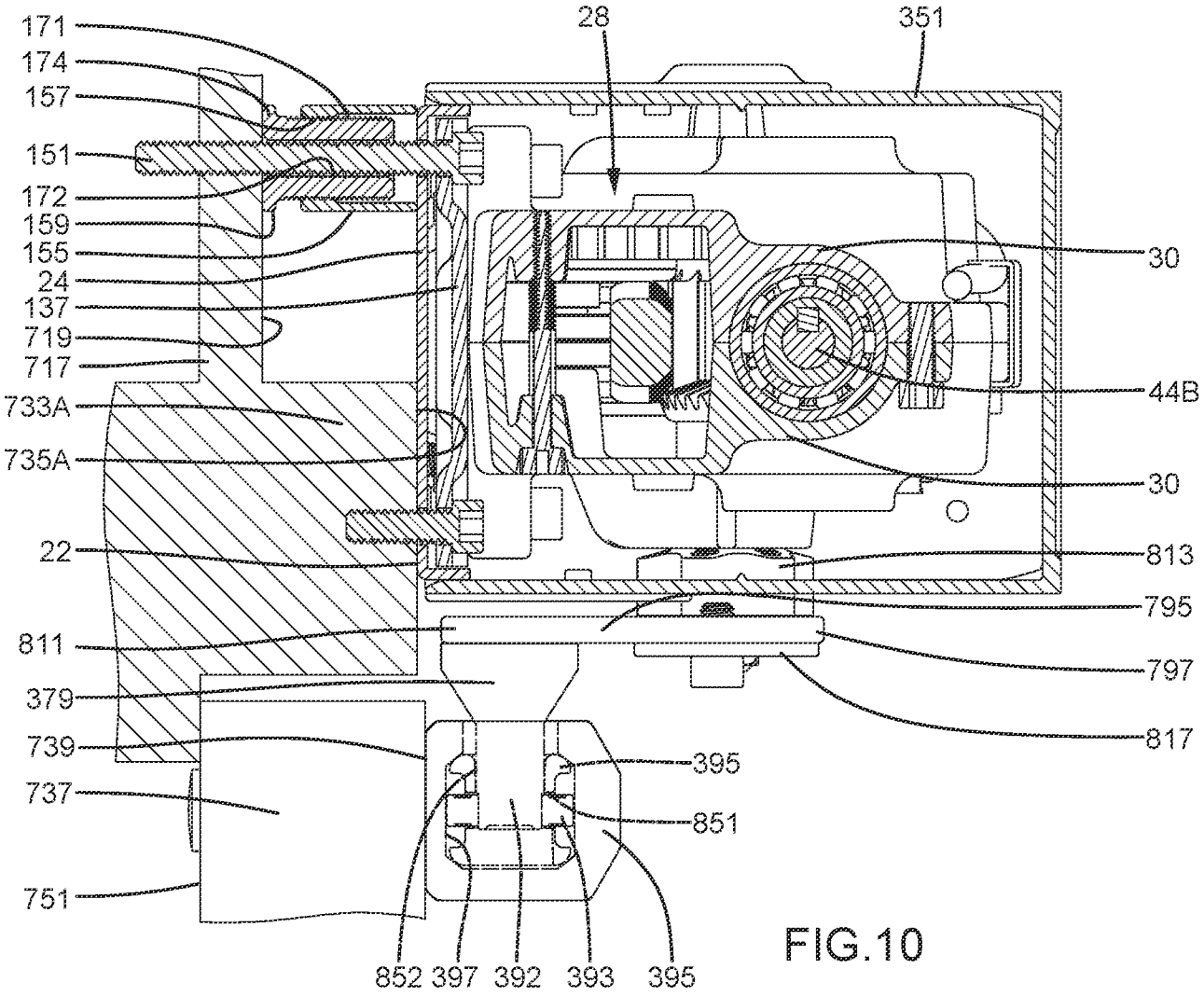
FIG. 10 is a cross sectional view taken along section line 10-10 of FIG. 6.

The linking unit 794 further includes a track member 395 mounted to an upper end of the first surface 739 of the door 737 and a sliding block 839, as shown in FIGS. 5, 8, and 10. The track member 395 includes a track 397 extending in the lateral direction. The sliding block 839 includes a receiving groove 851 and a pivot hole 852 extending from an upper face of the sliding block 839 to the receiving groove 851. The sliding block 839 is slidably received in the track 397. A guiding wheel 393 is received in the receiving groove 851 of the sliding block 839. The guiding wheel 393 is received in the track 397 of the track member 395 and abuts a face of the track 397. The narrower portion 392 of the guiding wheel member 379 is pivotably coupled with the pivot hole 852 and the guiding wheel 393. Thus, when the first push rod 795 pivots, the sliding block 839 and the guiding wheel 393 slide along the track 397.

Two coupling pegs 399 extend through the second surface 751 towards but spaced from the first surface 739 of the door 737. Two bolts 511 extend through two ends of the track member 395 and threadedly engage with the two coupling pegs 399. Thus, the track member 395 is fixed to the first surface 739 of the door 737. The narrower portion 392 of the guiding wheel member 379 and the guiding wheel 393 are received in the track 397 of the track member 395.

Figure 11:
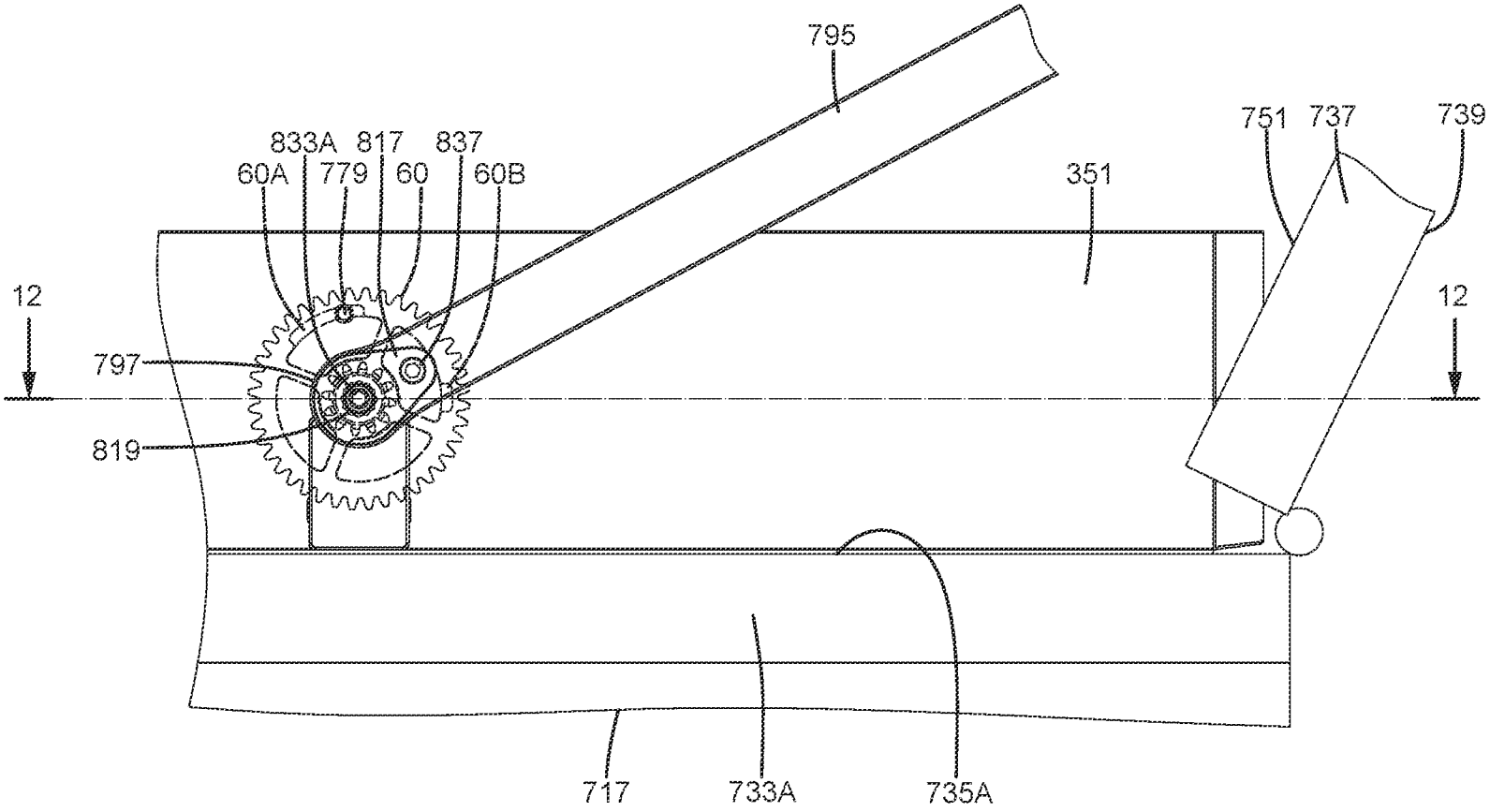
FIG. 11 is diagrammatic bottom view of the door opener and the door in an open position.
Figure 12:
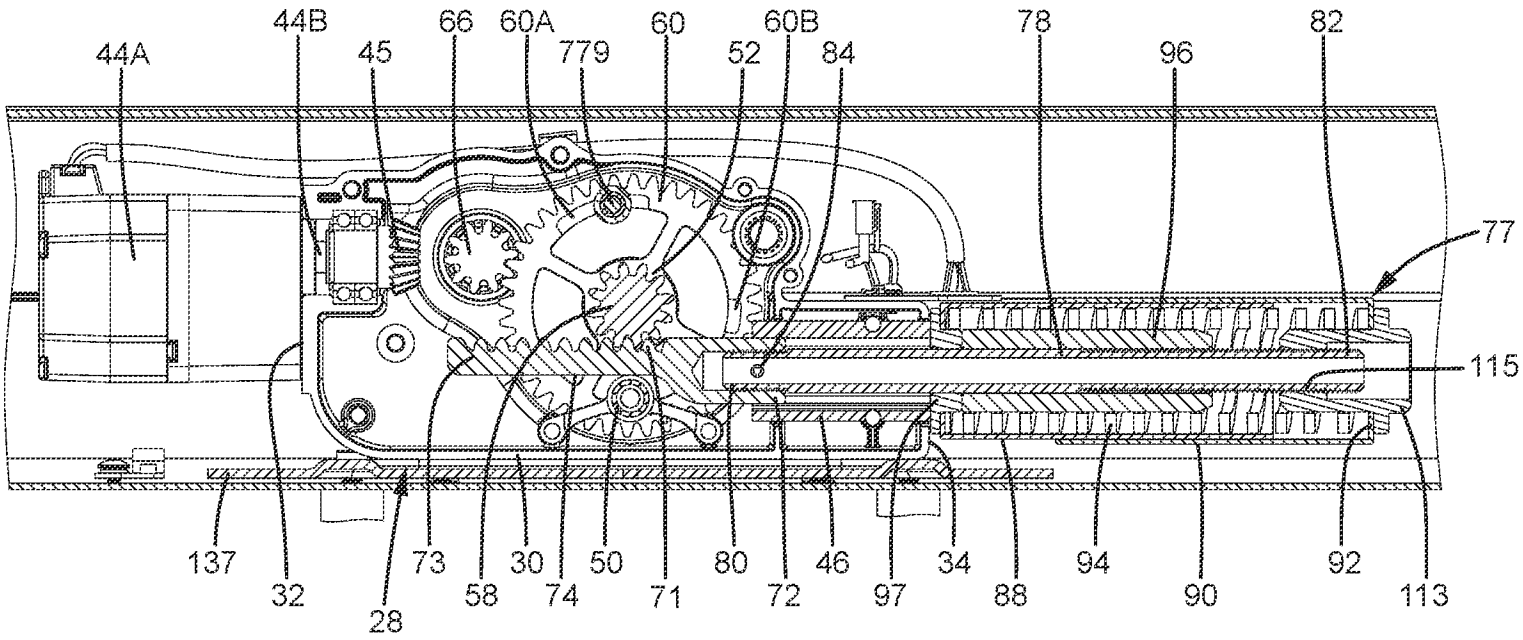
FIG. 12 is a cross sectional view taken along section line 12-12 of FIG. 11.

With reference to FIGS. 8 and 11, the pivoting direction of the door 737 pivoting from the closed direction to the open position and the assembling direction of the door opener 20 are at the same side, such that the door opener 20 can only be mounted above the top end of the door 737, avoiding the door opener 20 from interfering with pivotal movement of the door opener 20 towards the open position. Thus, a large portion of the mounting seat 22 of the door opener 20 will protrude outside of the first protrusive portion 733A. As a result, two supporting devices 153 (FIG. 4) are mounted to an outer side of the mounting seat 22 to securely fix the mounting seat 22 to the frame 717.

With reference to FIGS. 1 and 10, each of the two supporting devices 153 includes a lining 155 in the form of a cylinder and a supporting member 159 in threading connection with the lining 155. Each lining 155 includes a screw hole 157 with an inner threading. Each supporting member 159 includes an outer threaded portion 171 and a through-hole 172. Each supporting member 159 further includes a head 174 formed at an end of the outer threaded portion 171. The through-hole 172 extends from an end face of the head 174 through a distal end face of the outer threaded portion 171.

The outer threaded portion 171 of each of the two supporting members 159 is in threading connection with the screw hole 157 of an associated one of the linings 155. When relative rotation occurs between the two supporting members 159 and the two linings 155, the two supporting members 159 move towards or away from the bottom wall 24.

Each supporting device 153 is disposed on an outer face of the bottom wall 24 of the mounting seat 22 and is located between the bottom wall 24 and the first side 719. Since the perpendicular distance between the first side 719 and the first protrusive wall 735A may change, each supporting device 153 can be used to permit relative rotation between each supporting member 159 and the associated lining 155, such that the supporting device 153 may extend or shorten to span between and abut against the bottom wall 24 of the mounting seat 22 and the first side 719 of the frame 717. In this embodiment, an end of each lining 155 abuts against the bottom wall 24 of the mounting seat 22, and the head 174 abuts against the first side 719 of the frame 717.

Each supporting device 153 further includes two fasteners 151 extending through the reinforcing seat 137, the bottom wall 24, and the through-holes 172 of the two supporting members 159 and in threading connection with the frame 717. When the two fasteners 151 are tightened while the two supporting members 159 and the two linings 155 are not rotated, the two supporting devices 153 are tightly sandwiched between the first side 719 and the frame 717 and the bottom wall 24, such that an end of each of the two linings 155 abuts against the wall 24. Furthermore, the head 174 of each of the two supporting member 159 abuts against the first side 719 of the frame 717. Furthermore, a lower edge 27 of the mounting seat 22 abuts against the first protrusive wall 735A of the first protrusive portion 733A, securing fixing the whole door opener 20 to the frame 717.

The door opener 20 further includes an outer cover 351 having a window 353. The control panel 178 of the control device 175 is located in the window 353 and is, thus, exposed.

The structural features of the present invention have been set forth. To assist in understanding the technical features of the present invention, operation of the embodiment of the present invention will be set forth in association with corresponding drawings. Firstly, it is assumed that the door opener 20 has power and is in a normal operating state and the door 737 is in a closed position (FIGS. 6-9), the return spring 94 is in its original state (uncompressed state). The push rod 779 is spaced from the first and second detecting portions 60A and 60B of the second gear 60. The inner end 791 of the push rod 779 abuts a face of the second gear 60. Thus, the switch 793 of a normally closed type is activated, and the circuit of the generator mode operating module 796 is an open circuit, as shown in FIG. 9. Namely, when the door 737 is in the closed position, the generator mode operating module 796 cannot switch the motor 44A into the generator mode.

When the motor 44A operates, the driving gear 45 is driven by the rotor 44B to drive the second transmission member 62 to rotate, and the second transmission member 62 drives the first transmission member 52 to pivot. The first gear 58 of the first transmission member 52 pushes the sliding member 70 to slide in the lateral direction. Furthermore, the sliding member 70 actuate the connecting rod 78 and the adjusting ring 113 to move in the lateral direction. Furthermore, the adjusting ring 113 actuate the movable sleeve 90 to move in the lateral direction towards the supporting sleeve 46 and compresses the return spring 94.

Furthermore, during rotation of the first transmission member 52, the second mounting end 56 drives the first connecting member 813 to pivot, and the first connecting member 813 drives the first push rod 795 to pivot. The guiding wheel member 379 presses against the track member 395 to push the door 737 to pivot towards the open position (see FIG. 11). At the same time, the guiding wheel 393 of the guiding wheel member 379 slides along the track 397 of the track member 395.

It is worth noting that although the motor 44A operates to pivot the door 737 from the closed position to the open position, the second detecting portion 60B and the first detecting portion 60A will pass through (be aligned with) the inner end 791 of the push rod 779 in sequence. Namely, during the time period of the door opening process from the closed position to the open position (completely open), the generator mode operating module 796 will be in a conductive state in two time sections. Since the motor 44A operates under power supply, the motor 44A cannot be switched to the generator mode even though the generator mode operating module 796 is in the conductive state. Thus, operation of the rotor 44B of the motor 44A does not have to overcome the electromagnetic resistance.

Furthermore, according to the form shown, when the first transmission member 52 pivots, the second gear 60 drives the gear of the detection unit 68 to rotate. Thus, the detection unit 68 can identify the operation status of the motor 44, such as the operation time or rounds. Thus, the detection unit 68 can control the opening angle of the door 737.

With the door opener 20 having power and in the normal operating state, the pivotal movement of the door 737 from the open position to the closed position is achieved by reversing the rotation of the rotor 44B of the motor 44A. Specifically, assuming that the motor 44A rotates in a forward position to pivot the door 737 from the closed position to the open position, after a person passes through the door 737 or after a pre-determined period of time (such as a couple of seconds) has expired, the motor 44A rotates in a reverse direction to push the first connecting member 813 by the first transmission member 52. The first push rod 795 actuates the guiding wheel member 379 to press against the track member 395, which, in turn, pushes the door 737 to pivot towards the closed position. The second gear 60 drives the pinion of the detection unit 68 to rotate. Thus, how long or how many turns the motor 44A rotates for pivoting the door 737 from the open position to the closed position can be precisely detected. Furthermore, during the pivotal movement of the door 737 from the open position to the closed position, the movable sleeve 90 and the adjusting ring 113 move away from the supporting sleeve 46 and the transmission member 52 in the lateral direction, such that the return spring 94 restores to its original length.

During the door closing process from the open position to the closed position under operation of the motor 44A, the first detecting portion 60A and the second detecting portion 60B will pass through (be aligned with) the inner end 791 of the push rod 779 in sequence. Namely, during the door closing process, the generator mode operating module 796 will be in a conductive state in two time sections. Since the motor 44A operates under power supply, the motor 44A cannot be switched to the generator mode even though the generator mode operating module 796 is in the conductive state. Thus, operation of the rotor 44B of the motor 44A does not have to overcome the electromagnetic resistance.

Regardless of the power supply of the door opener 20, when the pivotal movement of the door 737 to the closed position or the open position is not achieved by supplying power to the motor 44A (such as by manual operation or the return spring 94), the track member 395 (jointly pivoting with the door 737) actuates the first push rod 795, the first connecting member 813, and the first transmission member 52 to pivot jointly. The first transmission member 52 actuates the second connecting member 62 and the rotor 44B to move. Since the rotor 44B is not driven by supplying power to the motor 44A, when the rotation of the rotor 44B causes the circuit of the generator mode operating module 796 to become conductive, the motor 44A will be switched to the generator mode, such that the rotation of the rotor 44B must overcome the electromagnetic resistance. Therefore, with the door opener 20 having power and being operable, when the door 737 pivots in a condition not relying on suppling power to the motor 44A, when the first and second detecting portions 60A and 60B are aligned with the inner end 791 of the push rod 779 (see FIGS. 11, 14, and 15, the switch 793 is not activated) during the pivotal movement of the door 737, the pivoting speed of the door 737 will be reduced due to resistance.

Specifically, in the case of power outage in which the door opener 20 cannot operate normally without power, when the door 737 is manually pushed from the closed position to the open position, the first push rod 795 actuates the first connecting member 813 and the first transmission member 52 to pivot jointly. The pivotal movement of the first transmission member 52 actuates the sliding member 70 to move in the lateral direction and causes rotation of the second transmission member 62. The sliding movement of the sliding member 70 causes the connecting rod 78, the adjusting ring 113 and the movable sleeve 90 to move jointly towards the supporting sleeve 46 in the lateral direction and compresses the return spring 94, and rotation of the second transmission member 62 causes rotation of the rotor 44B of the motor 44A.

During the opening process of the door 737 from the closed position to the open position, the second and first detecting portions 60B and 60A are aligned with the inner end 791 of the push rod 779 in sequence (see FIG. 15), such that the switch 793 is not activated in two time sections wherein the inner end 791 of the push rod 779 is aligned with the first and second detecting portions 60A and 60B. Therefore, the circuit of the generator mode operating module 796 becomes conductive during the two time sections, and the motor 44A is set to the generator mode, such that rotation of the rotor 44B of the motor 44A generates an induction current which is outputted. As a result, rotation of the rotor 44B has to overcome the electromagnetic resistance. Since pivotal movement of the door 737 is associated with the rotor 44B, during the door-opening pivotal movement of the door 737 in the two time sections, the pivoting speed of the door 737 will be reduced due to the electromagnetic resistance.

In a case that the door opener 20 is in a state of interruption of power supply state and the door 737 is in the open position, when the door 737 is released, the return spring 94 presses against the movable sleeve 90 to move away from the supporting sleeve 46 in the lateral direction, such that the adjusting ring 113, the connecting rod 78, and the sliding member 70 move jointly away from the supporting sleeve 46 in the lateral direction. Then, the sliding member 70 actuates the first transmission member 52 to pivot, which, in turn, actuates the second transmission member 62 to pivot. Furthermore, the first transmission member 52 also actuates the first connecting member 813 and the first push rod 795 to pivot jointly. As a result, the door 737 pivots from the open position to the closed position under the action of the return spring 94. Furthermore, the second transmission member 62 actuates the rotor 44B of the motor 44A to rotate.

During the pivotal movement of the door 737 from the open position to the closed position under the action of the return spring 94, the first and second detecting portions 60A and 60B are aligned with the inner end 791 of the push rod 779 in sequence (see FIGS. 15, 14, and 11), such that the switch 793 is not activated during the time periods where the first and second detecting portions 60A and 60B are aligned with the inner end 791 of the push rod 779. Therefore, the circuit of the generator mode operating module 796 becomes conductive in the two time sections, such that rotation of the rotor 44B of the motor 44A generates an induction current and has to overcome the electromagnetic resistance. As a result, during the door-closing pivotal movement of the door 737 in the two time sections, the pivoting speed of the door 737 will be reduced due to the electromagnetic resistance.

With reference to FIG. 11, when the door 737 reaches the open position (the door 737 is completely open), the first detecting portion 60A is aligned with the inner end 791 of the push rod 779, the switch 793 is not activated, the circuit of the generator mode operating module 796 becomes conductive, and the motor 44A is switched to the generator mode. Thus, at the first moment of pivoting the door 737 from the open position towards the closed position, the door 737 pivots slowly under the action of the electromagnetic resistance.

Figure 13:
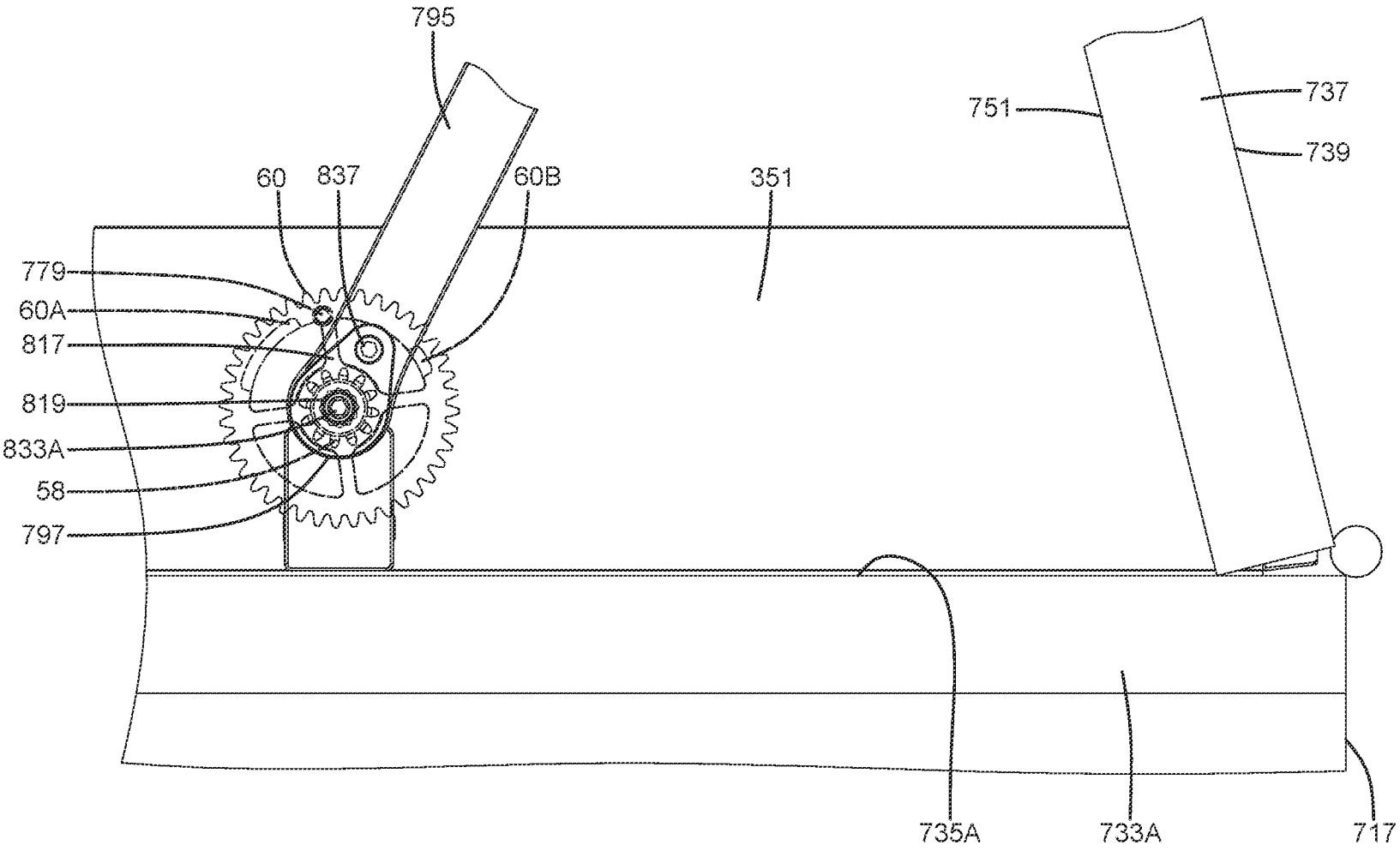
FIG. 13 is a view similar to FIG. 11 with the door pivoted towards a closed position.

With reference to FIG. 13, when the inner end 791 of the push rod 779 disengages from the first detecting portion 60A and is located between the first and second detecting portions 60A and 60B during the pivotal movement of the door 737 towards the closed position, the switch 793 is activated, such that the circuit of the generator mode operating module 796 becomes an open circuit. In the case that the inner end 791 of the push rod 779 is located between the first and second detecting portions 60A and 60B during the pivotal movement of the door 737 towards the closed position, the pivotal movement of the door 737 is not impeded by the electromagnetic resistance, and the pivoting speed of the door 737 will be increased until the inner end 791 of the push rod 779 is aligned with the second detecting portion 60B.

Figure 15:
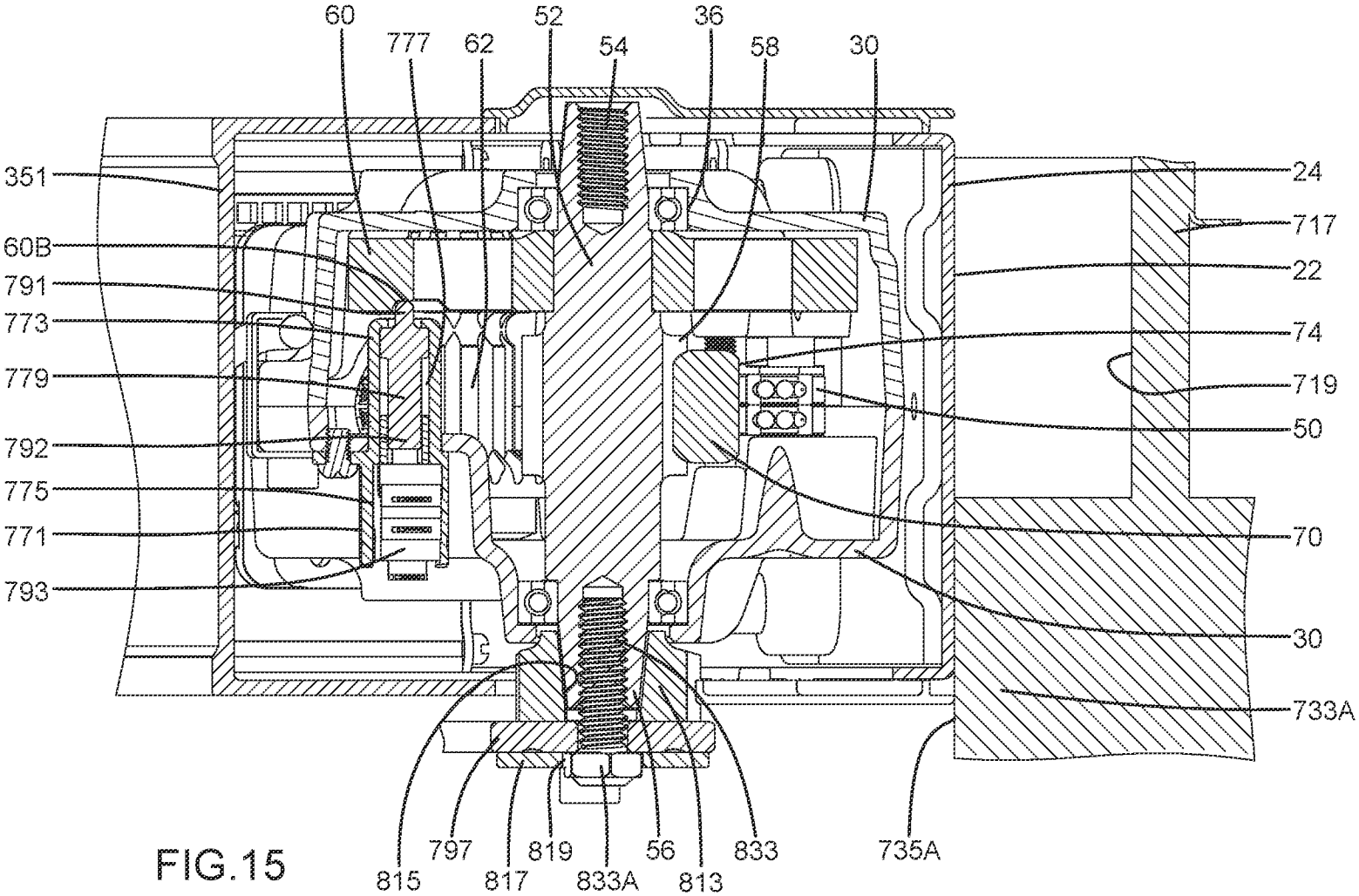
FIG. 15 is a cross sectional view taken along section line 15-15 of FIG. 14.

With reference to FIGS. 14 and 15, in this state, the circuit of the generator mode operating module 796 becomes conductive, and rotation of the rotor 44B of the motor 44A is impeded by the electromagnetic resistance. Thus, when the door 737 is near the closed position (e.g., the door 737 will reach the closed position after rotating 20-35 degrees in the door closing position), the pivoting speed of the door 737 towards the closed position is reduced until the door 737 reaches a position very close to the closed position. At this time, the inner end 791 of the push rod 779 disengages from the second detecting portion 60B, the circuit of the generator mode operating module 796 becomes an open circuit again, and the pivoting speed of the door 737 towards the closed position is increased until the door 737 reaches the closed position where the door 737 stops. It is worth mentioning that the acceleration of the pivoting speed of the door 737 approaching the closed position is helpful in retraction of a latch of the door lock. The latch will engage with an opening (not shown) in the frame 717 when the door 737 is completely in the closed position. The door 737 is, thus, positioned in the closed position.

It is worth mentioning that the manual return module 77 allows adjustment of the extent of pre-compression of the return spring 94 to thereby adjust the pivoting speed of the door 737 moving from the open position to the closed position.

Figure 7:
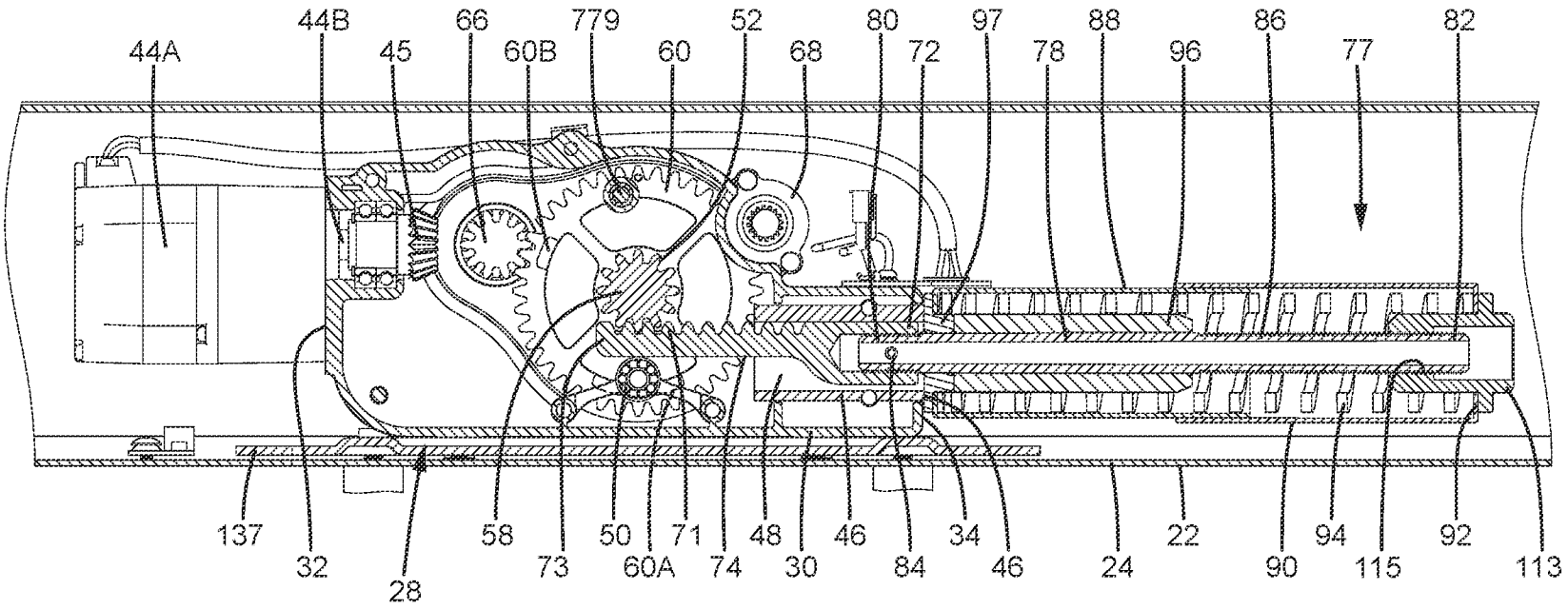
FIG. 7 is a cross sectional view taken along section line 7-7 of FIG. 6.
Figure 16:
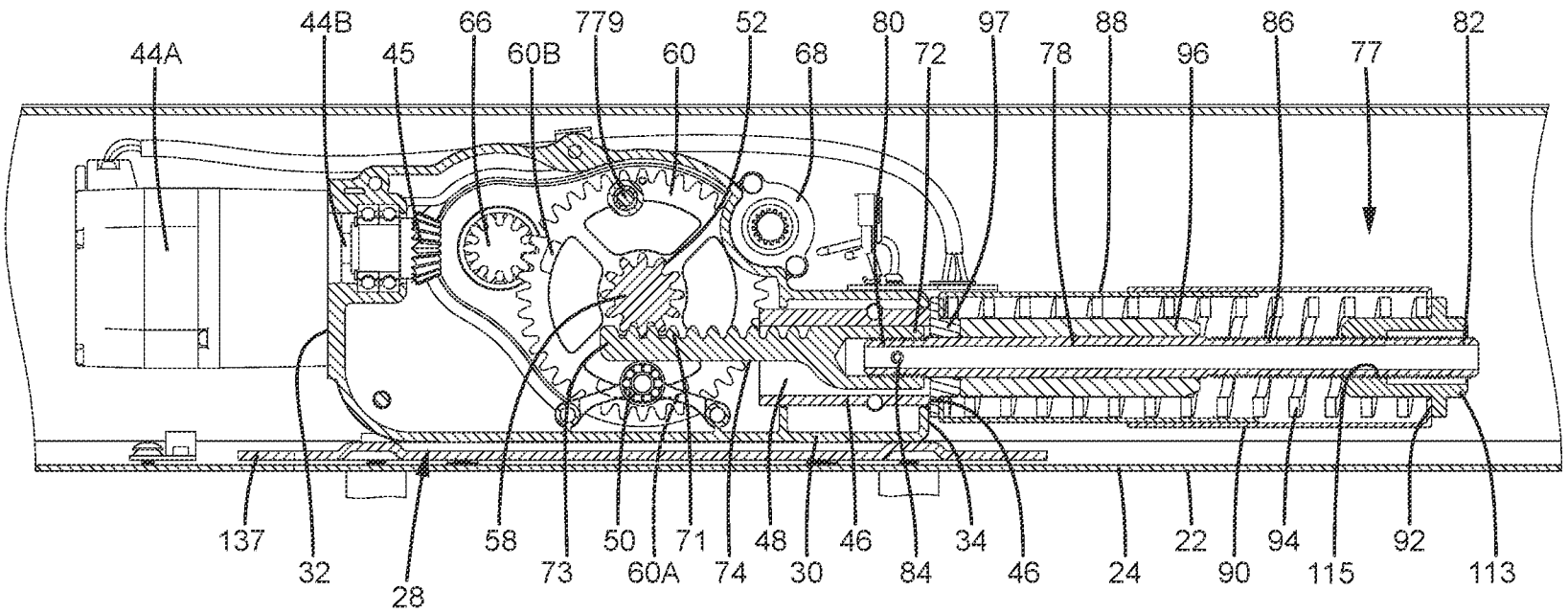
FIG. 16 is a view similar to FIG. 7 with an adjusting ring rotated to compress a return spring.

Specifically, with reference to FIG. 7, the adjusting ring 113 is at the outer end 82 of the connecting rod 78. In this state, the extent of pre-compression of the return spring 94 is minimal. Thus, when the door 737 is manually opened, the pivotal speed of the door 737 from the open position to the closed position is slowest. With reference to FIG. 16, the rotating adjusting ring 113 moves in the lateral direction. Thus, when the adjusting ring 113 rotates, the adjusting ring 113 also moves towards the supporting sleeve 46, such that the adjusting ring 113 presses against and actuates the movable sleeve 90 to move in the lateral direction towards the supporting sleeve 46. The return spring 94 is compressed during the movement of the movable sleeve 90 in the lateral direction towards the supporting sleeve 46. Thus, the larger the extent of pre-compression of the return spring 94, the larger the length of the portion of threaded section 86 of the connecting rod 78 outside of the movable sleeve 90 in the lateral direction, and the higher the pivoting speed of the door 737 towards the closed position under the action of the return spring 94. Thus, the extent of pre-compression of the return spring 94 can be adjusted according to practical needs, such as the weight of the door.

In can be appreciated that with the return spring 94 having a larger extent of pre-compression, the return spring 94 is further compressed when the door 737 pivots from the closed position to the open position, such that the return spring 94 provides a larger elastic force for moving the movable sleeve 90 to actuate the connecting rod 78 for moving the first transmission member 52 in the reverse direction. Thus, the door 737 pivots faster from the open position to the closed position, or a heavier door can be pushed to pivot from the open position to the closed position. Furthermore, the force for retaining the door 737 in the closed position is larger when the return spring 94 has a larger extent of pre-compression.

By the provision of the generator mode operating module 796 according to the present invention, when the door opener 20 is in a state of interruption of power supply state or loses the power for operation, the door 737 can be manually pivoted to set the motor 44A to the generator mode, such that the rotor 44B must overcome the electromagnetic resistance, which further effectively controls the pivoting speed of the door 737 towards the closed position under the action of the return spring 94. Therefore, the door-closing speed will not be too fast, and the door-closing force will not be too large.

The linking unit 794 is non-rotatably coupled with the first push rod 795 through the anti-loose member 817, and the connecting screw 833 and the anti-loose member 817 are non-rotatably coupled. Thus, in the case that the anti-loose member 817 is not removed, the connecting screw 833 (whose rotating axis is the same as that of the first transmission member 52) cannot rotate independently relative to the first transmission member 52 and the first push rod 795, such that the first connecting member 813 will not disengage from the first transmission member 52 due to operation of the driving device 28.

The anti-loose member 817 is in threading connection with the first push rod 795 via the anti-loose screw 837 which cooperates with the connecting screw 833, such that the anti-loose member 817 can only pivot jointly with the first push rod 795, and the connecting screw 833 cannot pivot relative to the anti-loose member 817. This further assures that the connecting screw 833 will not become loose gradually due to pivotal movement of the first push rod 795 pushed by the driving device 28.

Since the second mounting side 56 and the connecting hole 815 have a conicity, the second mounting side 56 and the connecting hole 815 can be automatically centered during coupling, thereby achieving simple assembly and the tightening effect.

The track 397 of the track member 395 is received in the sliding block 839 and the guiding wheel 393, and the narrower portion 392 of the guiding wheel member 379 is pivotably coupled with the sliding block 893 and the guiding wheel 393, such that the assembly of the sliding block 839, the guiding wheel 393, and the guiding wheel member 379 is more convenient.

After the door 737 is manually opened while the door opener 20 is out of electricity, the driving device 28 permits the door 737 to automatically return to the closed position through the manual return module 77. Furthermore, the adjusting ring 113 of the manual return module 77 is located outside of the movable sleeve 90, permitting easy adjustment of the extent of pre-set compression of the return spring 94 according to practical needs.

The inner diameter of the movable sleeve 90 is slightly greater than the outer diameter of the return spring 94, and the outer diameter of the inner tube 96 is slightly smaller than the inner diameter of the return spring 94. Furthermore, the end of the movable sleeve 90 distant to the abutting end 92 is adjacent to an end of the inner tube 96. Thus, the return spring 94 will not distort during compression. As a result, operation of the manual return module 77 is smoother.

The roller 50 of the supporting sleeve 46 supports the sliding member 70, permitting smooth displacement of the sliding member 70 in the lateral direction.

Now that the basic teachings of the present invention have been explained, many extensions and variations will be obvious to one having ordinary skill in the art. For example, the switch 793 can be a device other than the contact-type micro switch, such as a photoelectric switch or a magnetic reed switch. In the case that the switch 793 is a photoelectrical switch, movement of the push rod 779 is used to block or not block the detecting light of the photoelectric switch. In another case that the switch 793 is a magnetic reed switch, the push rod 779 may be formed of a magnetic material.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door opener comprising:

a casing;

a motor coupled to the casing and including a rotor;

a generator mode operating module electrically connected to the motor, wherein the generator mode operating module is configured to set the motor to a generator mode, wherein when the generator mode operating module sets the motor to the generator mode, rotation of the rotor outputs electric current and is impeded by an electromagnetic resistance;

a first transmission member pivotably mounted to the casing, wherein the motor is configured to drive the first transmission member to pivot, wherein the first transmission member includes a first detecting portion and is configured to operatively connect with a door to thereby operatively connect the door with the rotor, wherein when the motor is supplied with power to operate, the first transmission member is driven to pivot, thereby pivoting the door to an open position or a closed position, and wherein when the rotation of the rotor is impeded by the electromagnetic resistance, a pivoting speed of the door is reduced; and a switching module in electrical connection with the generator mode operating module, wherein when the first detecting portion is in one of a first status activating the switching module and a second status not activating the switching module, the generator mode operating module sets the motor to the generator mode, wherein when the first detecting portion is in another of the first status activating the switching module and the second status not activating the switching module, the generator mode operating module does not set the motor to the generator mode, wherein when the motor is set to the generator mode and the pivotal movement of the door is not caused by operation of the motor supplied with power, rotation of the rotor is impeded by the electromagnetic resistance to reduce the pivoting speed of the door, wherein when the motor is not set to the generator mode and the pivotal movement of the door is not caused by operation of the motor supplied with power, rotation of the rotor is not impeded by the electromagnetic resistance, and the pivoting speed of the door is increased.

2. The door opener as claimed in claim 1, further comprising a manual return module operatively connected to the first transmission member, wherein the manual return module includes a return spring, and wherein the return spring is configured to pivot the door from the open position to the closed position when the door opener loses power and the door is in the open position, causing the first transmission member to actuate the rotor to rotate.

3. The door opener as claimed in claim 2, further comprising a second transmission member coupled with the motor, wherein the first transmission member includes a first gear and a second gear rotating jointly with the first gear, wherein the second transmission member includes a third gear meshed with the second gear, wherein the first detecting portion is mounted on a face of the second gear, wherein the manual return module includes a sliding member operatively coupled with the return spring, wherein the sliding member meshes with the first gear, wherein when the motor operates, the sliding member moves in a lateral direction, and the return spring is compressed or elongated, and wherein the sliding member is configured to actuate the first transmission member, the second transmission member, and the motor to rotate when the door pivots.

4. The door opener as claimed in claim 3, wherein the manual return module further includes:

a connecting rod coupled to the sliding member to move jointly, wherein the connecting rod includes a threaded portion; and an adjusting ring in threading connection with the threaded section of the connecting rod and located outside of the casing, wherein when the first transmission member does not pivot, rotation of the adjusting ring causes displacement of the adjusting ring in the lateral direction to change an extent of pre-compression of the return spring, wherein when the first transmission member pivots in a first direction, the connecting rod and the adjusting ring together move in the lateral direction towards the first transmission member, and the return spring is compressed, and wherein the first transmission member pivots in a second direction reverse to the first direction, the connecting rod and the adjusting ring together move in the lateral direction away from the first transmission member, and the return spring restores its length.

5. The door opener as claimed in claim 4, wherein the manual return module further includes:

a fixing sleeve mounted around the return spring and not movable in the lateral direction, wherein an end of the return spring abuts against the fixing sleeve; and a movable sleeve mounted around the return spring and movably mounted to the fixing sleeve in the lateral direction, wherein another end of the return spring abuts against the movable sleeve, wherein the adjusting ring abuts an outer side of the movable sleeve, wherein when the first transmission sleeve does not pivot and the adjusting ring rotates and displaces in the lateral direction, the movable sleeve and the adjusting ring displace together in the lateral direction, wherein the extent of pre-compression of the return spring increases when a length of a portion of the connecting rod outside of the movable sleeve increases, and wherein the connecting rod, the adjusting ring, and the fixing sleeve are jointly movable in the lateral direction when the first transmission member pivots.

6. The door opener as claimed in claim 1, wherein the switching module further includes:

an installation seat fixed to the casing, wherein the installation seat includes an installation groove and a movement hole intercommunicating with the installation groove;

a switch mounted in the installation groove; and a push rod movably received in the movement hole, wherein the push rod is located between the switch and the first transmission member, wherein pivotal movement of the first transmission member causes the first detecting portion to move to a position aligned with the push rod or another position not aligned with the push rod, wherein when the first detecting portion is aligned with the push rod, the switch is not activated, and wherein when the first detecting portion is not aligned with the push rod, the switch is activated.

7. The door opener as claimed in claim 6, wherein the first transmission member further includes a second detecting portion spaced from the first detecting portion in a circumferential direction about a rotating axis of the first transmission member, wherein when the second detecting portion is aligned with the push rod, the switch is not activated, wherein when the second detecting portion is not aligned with the push rod, the switch is activated, wherein the first detecting portion is configured to reduce an initial speed of the door starting to pivot from the open position to the closed position, and wherein the second detecting portion is configured to reduce the pivoting speed of the door approaching the closed position.

8. The door opener as claimed in claim 7, wherein each of the first and second detecting portions is in a form of a groove, wherein the first and second detecting portions are spaced from each other by 90°-120° in the circumferential direction about the rotating axis of the first transmission member, and wherein an extent of the first detecting portion in the circumferential direction about the rotating axis of the first transmission member is greater than an extent of the first detecting portion in the circumferential direction about the rotating axis of the first transmission member.

* * * * *